US008814487B2

(12) United States Patent
Yater et al.

(10) Patent No.: US 8,814,487 B2
(45) Date of Patent: Aug. 26, 2014

(54) IMPACT ABSORBING ACCESS PLATFORM FOR DRILLING STRUCTURES

(75) Inventors: Ronald William Yater, Houston, TX (US); Brian Daniel Winter, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 226 days.

(21) Appl. No.: 13/369,044

(22) Filed: Feb. 8, 2012

(65) Prior Publication Data

US 2012/0201632 A1 Aug. 9, 2012

Related U.S. Application Data

(60) Provisional application No. 61/440,966, filed on Feb. 9, 2011.

(51) Int. Cl.
*E21B 19/00* (2006.01)

(52) U.S. Cl.
USPC ..... 414/22.63; 414/22.65; 211/70.4

(58) Field of Classification Search
USPC ..... 414/22.51–22.71; 211/70.4
See application file for complete search history.

(56) References Cited

U.S. PATENT DOCUMENTS

| | | | | | |
|---|---|---|---|---|---|
| 2,191,643 | A | * | 2/1940 | Deckard | 182/114 |
| 2,309,041 | A | * | 1/1943 | Booker et al. | 174/43 |
| 2,662,797 | A | * | 12/1953 | Moon | 182/114 |
| 3,805,902 | A | | 4/1974 | Storm et al. | |
| 4,269,384 | A | * | 5/1981 | Saeed et al. | 248/548 |
| 4,278,228 | A | * | 7/1981 | Rebentisch et al. | 248/548 |
| 4,393,630 | A | * | 7/1983 | Knox | 52/121 |
| 4,440,262 | A | | 4/1984 | Hunt et al. | |
| 4,696,207 | A | | 9/1987 | Boyadjieff | |
| 4,765,401 | A | | 8/1988 | Boyadjieff | |
| 5,029,757 | A | * | 7/1991 | Bourgault et al. | 239/167 |
| 5,468,071 | A | * | 11/1995 | Tourneux et al. | 384/276 |
| 5,671,823 | A | * | 9/1997 | Oakes | 182/36 |
| 6,543,551 | B1 | | 4/2003 | Sparks et al. | |
| 6,821,071 | B2 | | 11/2004 | Woolslayer et al. | |
| 7,083,007 | B2 | | 8/2006 | Herst | |
| 7,246,983 | B2 | | 7/2007 | Zahn et al. | |
| 2006/0104747 | A1 | | 5/2006 | Zahn et al. | |
| 2008/0164064 | A1 | | 7/2008 | Belik et al. | |
| 2009/0095283 | A1 | * | 4/2009 | Curtis et al. | 126/704 |
| 2009/0159294 | A1 | * | 6/2009 | Abdollahi et al. | 166/377 |
| 2009/0257848 | A1 | | 10/2009 | Stroshein et al. | |
| 2010/0303586 | A1 | | 12/2010 | Hankins et al. | |

OTHER PUBLICATIONS

PCT Search Report and Written Opinion from PCT/US2012/024415 dated May 28, 2013.

* cited by examiner

*Primary Examiner* — Gregory Adams
*Assistant Examiner* — Lynn Schwenning
(74) *Attorney, Agent, or Firm* — Amerson Law Firm, PLLC

(57) ABSTRACT

Generally, the subject matter disclosed herein relates to an impact absorbing "diving board," or access platform, of a drilling rig "fingerboard," or pipe racking assembly. One illustrative diving board assembly of a drilling rig fingerboard assembly disclosed herein includes a first end proximate the drilling rig and a second end positioned remote from the first end, where the first end is more proximal to the drilling rig than the second end. The illustrative diving board assembly further includes a clamping assembly operatively coupled to the first end and to the second end, where the clamping assembly is positioned between the first and second ends and defines a pinned connection adapted to permit a rotation of the first and second ends relative to a plane defined by the fingerboard assembly.

53 Claims, 14 Drawing Sheets

IMPACT ABSORBING ACCESS PLATFORM FOR DRILLING STRUCTURES

BACKGROUND

1. Field of the Disclosure

The present invention relates generally to methods and apparatus for handling pipes and other tubular members during drilling and/or workover operations of a well. More specifically, the present invention relates to an impact absorbing "diving board," or access platform, of a "fingerboard," or pipe racking assembly, used for staging pipes and other tubular members adjacent to a drilling rig in a substantially vertical orientation while the drilling and/or workover operations are being performed.

2. Description of the Related Art

Drilling masts are vertical structures that are commonly used to support a drill string while a well is being drilled. Drilling masts usually have a relatively compact, rectangular footprint, as opposed to a derrick structure, which typically has a steep pyramidal shape. The rectangular shape of the typical drilling mast also offers relatively good overall stiffness, which allows the mast to be lowered to a horizontal position. The compact, rectangular shape of the drilling mast structure therefore facilitates transportation of the drilling rig over surface roads, many times without the need for obtaining special shipping permits, and thereby making drilling masts very common on portable land-based drilling rigs. FIG. 1*a* shows an elevation view of an illustrative portable land-based drilling rig 1 having a drilling mast 2.

During typical drilling operations, a string of drill pipe—shown as reference number 6 in FIG. 1*a*—which may have a drill bit mounted on the lower end of the drill string 6, may be suspended from a traveling block 3 and top drive assembly 4 in the drilling mast 2. As may be required for some specific drilling operation, the top drive 4 assembly imparts a rotational force to the drill string 6, thereby turning the drill bit and advancing the depth of the drilled wellbore. As the depth of the wellbore increases, additional lengths of drill pipe are added to the drill string 6 at the surface.

Due to the relatively compact footprint that may be associated with drilling mast structures, there may be very limited space available for storing the drill pipe and other tubular members adjacent to the drilling mast 2. Therefore, in many cases, the drill pipe may be vertically staged in a specially designed structural assembly—sometimes referred to as a racking board or fingerboard 5—that is attached to the drilling mast 2, as shown in FIG. 1*a*. The fingerboard 5 is specifically designed to facilitate the vertical arrangement of the various sections of drill pipe during the drilling operations. While the fingerboard 5 is commonly attached directly to the drilling mast 2, it may be positioned many feet—for example, 75 feet or more—above the drilling rig floor 7, depending on the length of the various sections of staged drill pipe. FIGS. 1*b* and 1*c* show a close-up elevation view and a plan view, respectively, of the position of the fingerboard 5 relative to the drilling mast 2, the traveling block 3, the top drive assembly 4, and the drill string 6.

"Tripping" is a term of art used in drilling operations that generally refers to acts of either adding multiple joints of drill pipe to, or removing multiple joints of drill pipe from, a drilled wellbore. Oftentimes during the drilling operations, tripping operations may be performed wherein the drill string 6 is pulled from the wellbore in order to change the drill bit, or to run various other types of equipment, such as testing equipment and the like, into the wellbore on the end of the drill string 6. When tripping drill pipe out of the wellbore, the traveling block 3 and top drive assembly 4 may be raised until a stand of drill pipe (i.e., generally multiple connected sections, or joints, of drill pipe) extends above the drilling rig floor. In most cases, a stand of drill pipe may comprise two or three joints of drill pipe, with the most common pipe stand configuration being three joints of drill pipe, totaling approximately 90 feet in length. Thereafter, slips are placed between the string of drill pipe and the drilling rig floor in order to suspend the drill string 6 in and above the wellbore from a point beneath the bottom threaded joint of the stand of drill pipe that is to be removed from the drill string. In this position, the drill string 6 extends above the drilling rig floor 7, and the upper end, or box end, of the string is positioned above the plane of the fingerboard 5, which, as noted previously, may be located 75 feet or more above the drilling rig floor 7.

Once the drill string 6 has been suspended with its box end positioned above the fingerboard 5, the threaded connection between the stand of drill pipe and the remainder of the drill string 6 is then unthreaded, and the lower end, or pin end, of the stand is guided away from the remainder of the drill string 6 and wellbore and placed on a support pad—sometimes referred to as a setback—on the drilling rig floor 7. Next, the box end of the stand of drill pipe is removed from the traveling block 3/top drive assembly 4 and the stand is typically manually guided by drilling rig personnel to the fingerboard 5, where it is staged between a set of racking fingers 8 (see FIG. 1*c*) in a substantially vertical orientation. In this position, the box end of the removed stand of drill pipe remains a few feet above the plane 5*p* of the fingerboard 5. The top drive assembly 4 is then lowered to the box end of the suspended drill string by the traveling block 3 and coupled to the drill string 6. Thereafter, the drill string 6 is again lifted to a position where the box end is positioned above the plane 5*p* of the fingerboard 5, and the process is repeated until all of the sections of pipe—e.g., in three joint stands—are supported at their respective pin ends on the setback, with their respective box ends being constrained between pairs of racking fingers 8 on the fingerboard 5. When a new drill bit or other type of tool is being run into the well, the above-described tripping process is reversed and repeated, as the pin end of each stand of drill pipe is threaded into the box end of the drill string 6, and the drill string 6 is lowered into the well until the drill bit or other tool reaches a desired depth in the wellbore.

The movement of stands of drill pipe from the top drive assembly 4 to the racking fingers 8 of the fingerboard 5 is often manually effectuated by rig personnel, who may pull and/or push the drill pipe to its proper staging location. Furthermore, it is generally well understood that such movements of large sections of drill pipe may involve a variety of difficulties that, if not properly addressed by rig personnel involved in the work, may be hazardous to those personnel working above the rig floor and near the fingerboard. For example, the job of maneuvering the stand of drill pipe to its proper staging location may entail such activities as reaching out from the area of the fingerboard 5 to where the stand of drill pipe is located above the centerline 9 (see FIG. 1*c*) of the well in order to disconnect the box end of the stand from (and/or to connect the box end to) the top drive assembly 4. Furthermore, the work may include moving the upper end of each stand of drill pipe from its location at or near the centerline 9 of the well over to and into the racking fingers 8 of the fingerboard 5, and vice versa. To enable rig personnel to perform these operations safely, the fingerboard 5 may include access platforms 10 adjacent to and surrounding the racking fingers 8. The fingerboard 5 may also sometimes include an additional access platform 11, sometimes referred to as a diving board 11, in order to facilitate easier access to the traveling block 3, the top drive assembly 4, and/or the drill string 6. As shown in FIG. 1*c*, the diving board 11 may in some instances run down the center of the fingerboard 5—i.e., between rows of racking fingers 8—and extend away from the fingerboard 5 towards the centerline 9 of the well. Additionally, the diving board 11 may included hinged extension section 11*a*, which may be folded out for closer access to the centerline 9 of the well, or folded back to provide more clearance between the traveling block 3/top drive assembly 4 and the diving board 11 during some rig operations.

Recently, various efforts have been undertaken to automate at least some aspects of the operations that are commonly used for running drill pipe into and out of the wellbore—i.e., tripping the drill string—so as to avoid at least some of the constant interaction of rig personnel with the various pieces of equipment and materials that are in motion during drilling operations, such as the drill string 6, the traveling block 3, and/or the top drive assembly 4. For example, some complex automatic systems have been developed to perform the pipe handling steps of moving the stands of drill pipe between the pipehandler assembly 4*a* (see FIG. 1*b*)—which is a key pipe handling component of the top drive assembly 4—positioned at the centerline 9 of the well and the fingerboard 5. Additionally, some of these exemplary automatic systems include devices and equipment that move the stands of drill pipe around the fingerboard 5 and into (or out of) the racking fingers 8. In order to facilitate movement of the stands of drill pipe in and around the fingerboard 5, some of these exemplary automatic systems may utilize the structure of the centrally-located access platform—i.e., the diving board 11—to support the additional devices and/or equipment necessary to perform these pipe handling activities. Depending on the overall design of the automatic pipe handling system, the structural integrity of the diving board 11 may, in some cases, be significantly enhanced, thereby resulting in a much larger, heavier, and more complex assembly.

During the above described pipe tripping operations, it is very common for the traveling block 3 to be raised and/or lowered very quickly, which can help to speed up these otherwise time-consuming—and costly—drill pipe handling operations. However, due to the speed of these activities, the time that rig personnel may have to react to anomalies in the overall operations—such as errors, mistakes, or oversights by other personnel, or to otherwise unanticipated equipment failures—may be significantly reduced, thereby increasing the likelihood that accidents may occur. By way of example, in some cases, the top drive assembly 4 may not be properly oriented or aligned during some phases of the operations, which may cause some portions of the top drive assembly 4 to project farther from the centerline 9 of the well than would otherwise be anticipated. In other cases, the links of the pipehandler assembly 4*a* may not be properly oriented or fully retracted, a situation which may also cause the top drive assembly 4 to project farther from the well centerline 9 than normal. Under such circumstances, it may be possible for the top drive assembly 4 to strike the diving board 11 as the top drive assembly 4 is being raised and/or lowered by the traveling block 3. The likelihood of such a strike may be further exacerbated in those cases where the diving board 11 includes a hinged extension section 11*a*, and when that hinged extension section 11*a* may be folded out for closer access.

The force that may be imparted to the diving board 11 by the moving mass of the traveling block 3, the top drive assembly 4, and the drill string 6—which will depend on the speed at which those elements are moving—may result in considerable damage to the structure of the diving board 11, the fingerboard 5, and even the top drive assembly 4. Furthermore, if proper safety procedures are not observed during drilling activities, there may be a substantial risk of injury to rig personnel during such occurrences. It should be further noted that any type of damage to the diving board 11, the fingerboard 5, and/or the top drive assembly 4 may result in significant and costly down-time for the rig while the necessary repairs are affected. Moreover, when the fingerboard 5 and diving board 11 incorporate devices and equipment associated with the types of complex automatic pipe handling systems discussed previously, the cost and down-time for repairing any damage may be substantially greater than that associated with relatively simple structural repairs.

Accordingly, there is a need to develop and implement new designs for the diving board structures of drilling rig fingerboards to address the issue of damage that may occur when the diving board may be inadvertently struck by drilling equipment during drilling operations. The present disclosure relates to methods and devices that may avoid, or at least reduce, the effects of one or more of the problems identified above.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

Generally, the subject matter disclosed herein relates to an impact absorbing "diving board," or access platform, of a drilling rig fingerboard or pipe racking assembly. One illustrative diving board assembly of a drilling rig fingerboard assembly disclosed herein includes, among other things, a first end proximate the drilling rig and a second end positioned remote from the first end, where the first end is more proximal to the drilling rig than the second end. The illustrative diving board assembly further includes a clamping assembly operatively coupled to the first end and to the second end, where the clamping assembly is positioned between the first and second ends and defines a pinned connection adapted to permit a rotation of the first and second ends relative to a plane defined by the fingerboard assembly.

The present subject matter also discloses a pipe racking system of a drilling that includes, among other things, a fingerboard assembly adapted for staging one or more sections of pipe in a substantially vertical orientation, where at least a portion of the fingerboard assembly is positioned in a substantially horizontal plane and comprises two laterally opposing rows of racking fingers. The disclosed pipe racking system further includes a pivotable diving board assembly substantially disposed between the two laterally opposing rows of racking fingers, where the diving board assembly is adapted to provide access from the fingerboard assembly to one or more pipes used during normal drilling operations. Additionally, the pipe racking system disclosed herein also includes a diving board clamping assembly that is adapted to maintain the pivotable diving board assembly in a first position under a first operating condition and to permit an angular rotation of the pivotable diving board assembly to a second position located at an angle relative to the plane of the fingerboard assembly under a second operating condition.

In another illustrative embodiment of the present subject matter, a diving board assembly adapted to provide access to a fingerboard assembly of a drilling rig pipe racking system is disclosed herein. The disclosed diving board assembly includes, among other things, a first end proximate the drilling rig and a second end positioned remote from the first end, where the first end is more proximal to the drilling rig than the second end, and where the first and second ends are positioned in a first plane. The diving board assembly also includes at least one structural support member adapted to support a platform for accessing the fingerboard assembly, where the at least one structural support member is substantially parallel to the first plane. Furthermore, the diving board assembly includes a clamping assembly adapted to maintain the first plane of the diving board assembly substantially parallel to a plane defined by the fingerboard assembly during a normal operation of the drilling rig, where the plane of the fingerboard assembly is substantially horizontal.

The present subject matter also discloses a method of operation a rotatable impact-absorbing diving board assembly that includes installing a rotatable impact-absorbing diving board assembly proximate a fingerboard assembly of a drilling rig, where a plane of at least a portion of the fingerboard assembly is substantially horizontal. The method further includes, among other things, aligning the rotatable impact-absorbing diving board assembly with a plane that is substantially parallel to the plane of at least the portion of the fingerboard assembly, and clamping a clamping assembly of the rotatable impact-absorbing diving board assembly around a cylindrically shaped structural member, where the clamping assembly is adapted to permit an angular rotation of the rotatable impact-absorbing diving board assembly about a longitudinal axis of the cylindrically shaped structural member. Furthermore, the method includes causing an angular rotation of the rotatable impact-absorbing diving board assembly about the cylindrically shaped structural member.

BRIEF DESCRIPTION OF THE DRAWINGS

The disclosure may be understood by reference to the following description taken in conjunction with the accompanying drawings, in which like reference numerals identify like elements, and in which.

Figure 1A:
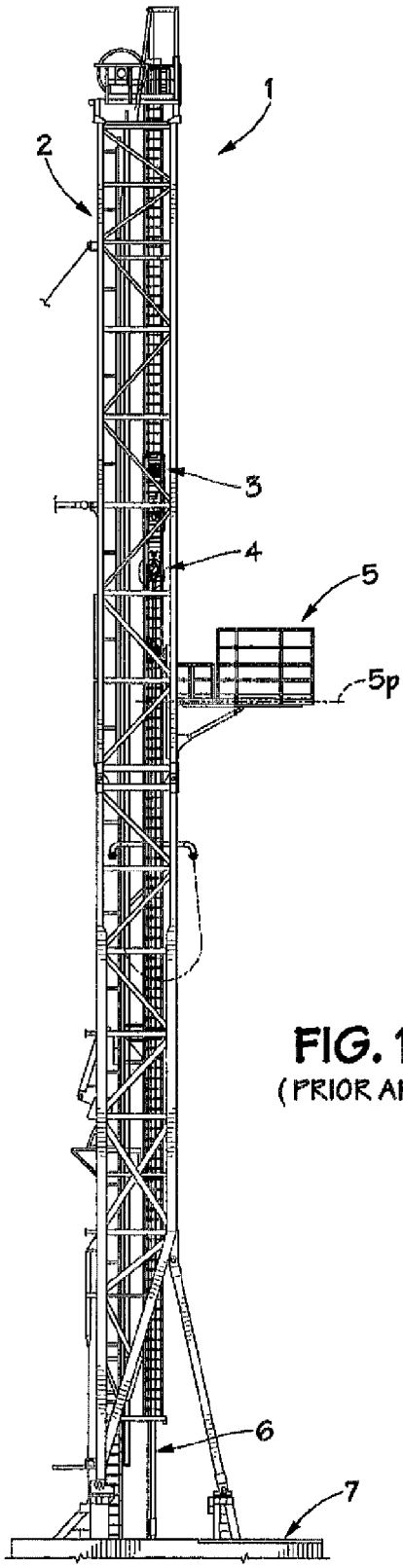
FIG. 1a (PRIOR ART)
FIG. 1*a* is an elevation view of an illustrative prior art portable land-based drilling rig assembly.
Figure 1B:
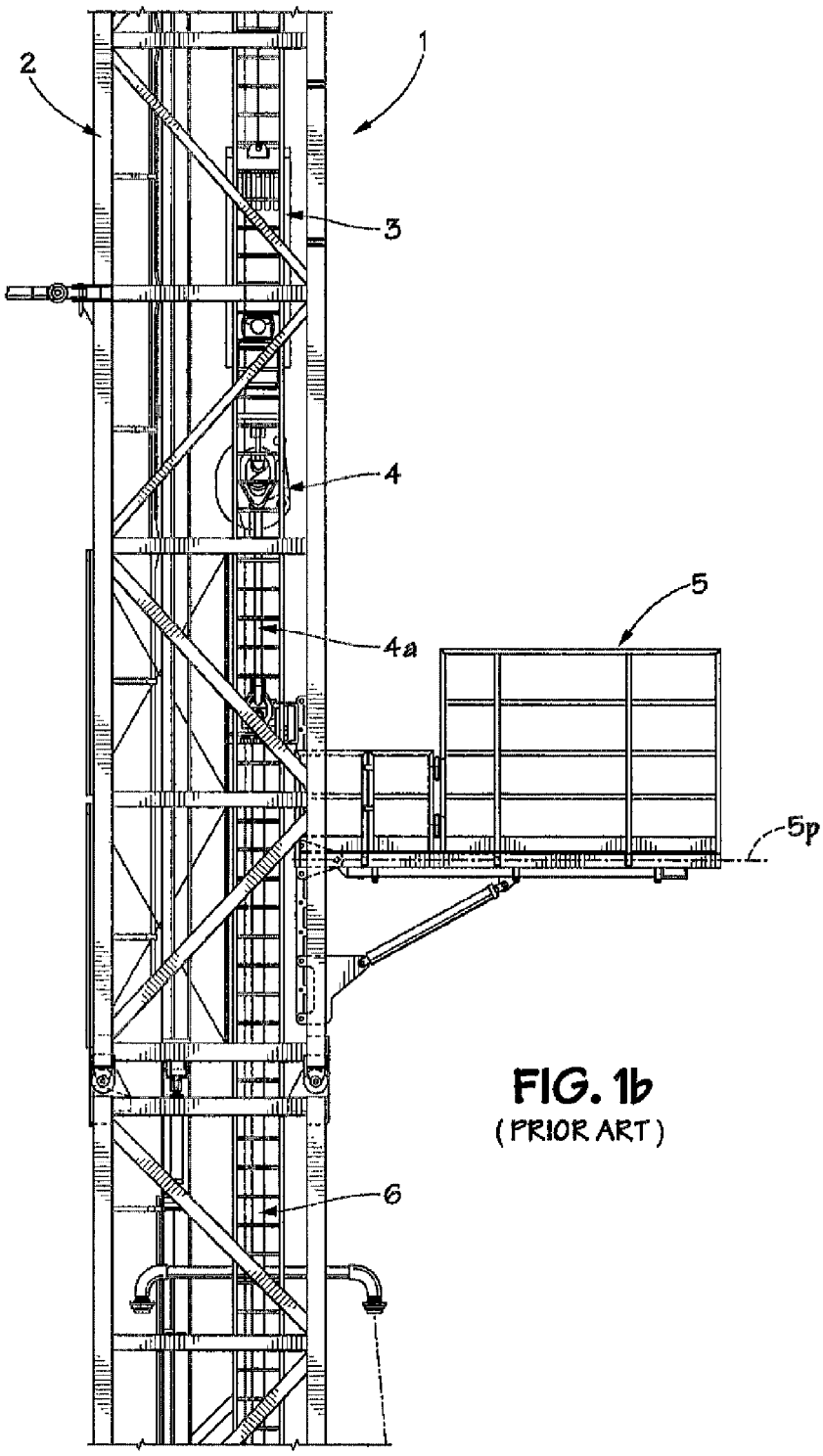
FIG. 1b (PRIOR ART)
FIG. 1*b* is a close-up elevation view of a fingerboard attached to a drilling mast of the illustrative prior art drilling rig assembly of FIG. 1*a;*
Figure 1C:
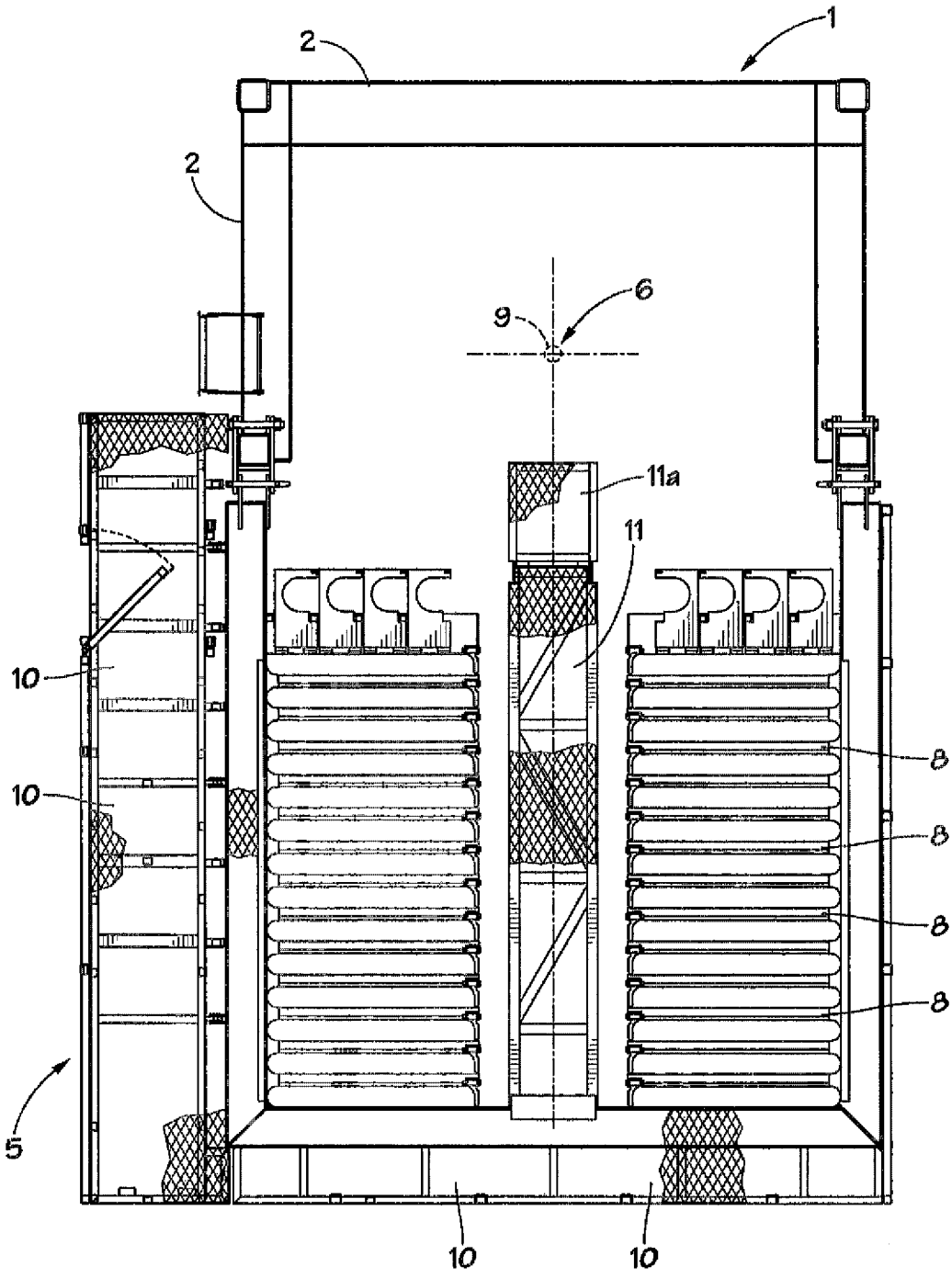
FIG. 1c (PRIOR ART)
FIG. 1*c* is a plan view of the fingerboard and drilling mast of the illustrative prior art drilling rig assembly shown in FIG. 1*b;*

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 2A:
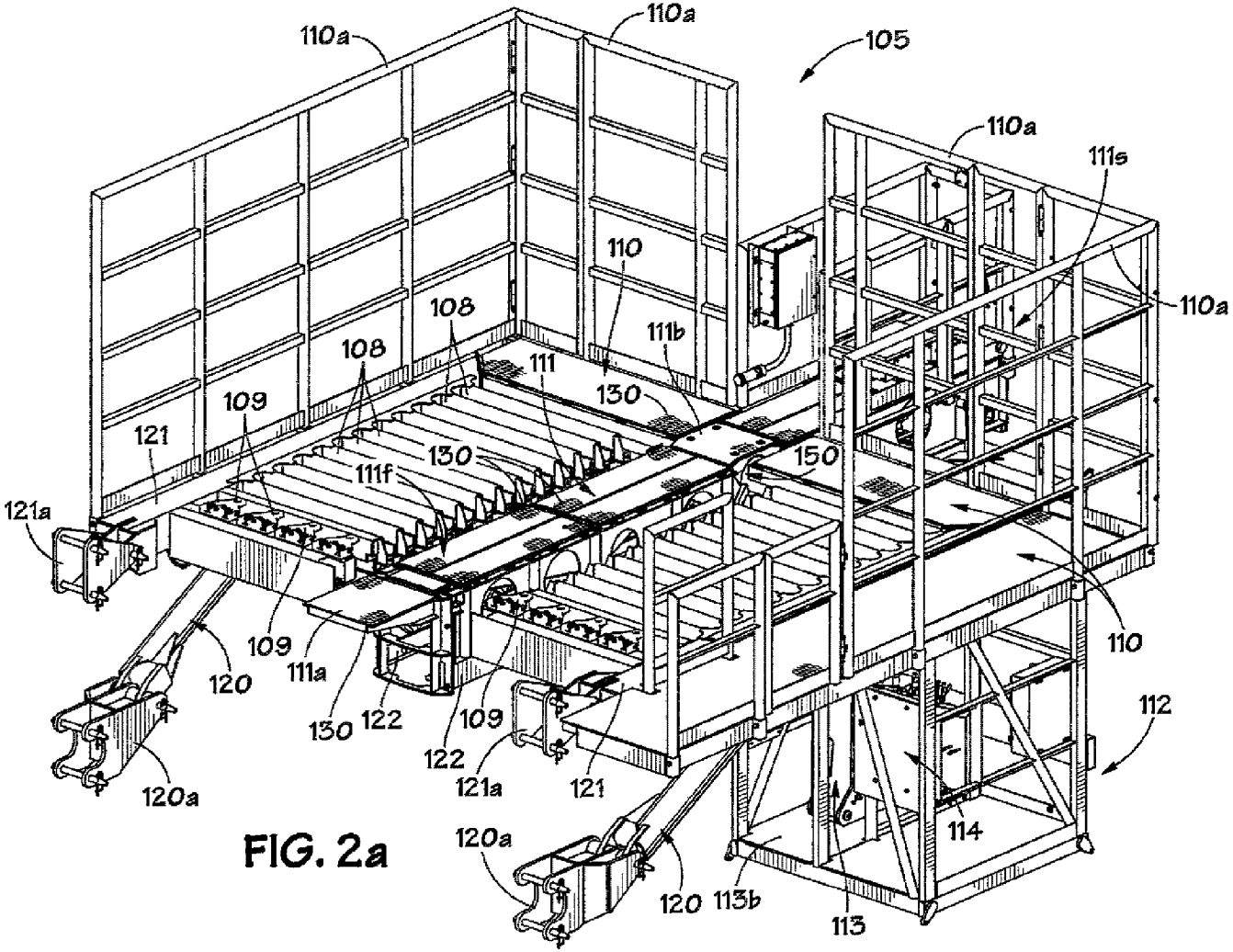
FIG. 2*a* is an isometric view of a fingerboard and an illustrative embodiment of the impact absorbing diving board of the present disclosure.

Generally, the subject matter disclosed herein relates to a pivotable, or rotatable, "diving board," or access platform, of a drilling rig "fingerboard," or pipe racking assembly, that is capable of absorbing high impact loads, such as blows from moving drilling equipment, while sustaining little or no significant damage. FIG. 2*a* depicts one illustrative embodiment of an impact absorbing diving board 111 in relation to an illustrative automatic pipe racking assembly, or fingerboard assembly 105. As shown in FIG. 2*a*, the fingerboard assembly 105 may include racking fingers 108 that may be used to facilitate the vertical staging of drill pipe, as discussed above. In some embodiments, the fingerboard assembly 105 may also include racking tabs 109 that may be used to vertically stage larger diameter tubular products, such as casing and the like.

In certain illustrative embodiments, the fingerboard assembly 105 may also include access platforms 110, which, as shown in FIG. 2*a*, may surround the fingerboard racking fingers 108 on one or more sides, thereby providing access as required by rig personnel to areas of the fingerboard assembly 105 during rig operations and/or maintenance activities. The platforms 110 may be covered on their upper surfaces by appropriately designed deck plates 130, such checkered plate, grating, expanded metal, and the like. Furthermore, the platforms 110 may also be surrounded by handrails 110*a* so to ensure the safety of rig personnel while accessing the various areas of the fingerboard assembly 105. Access to the platforms 110 may be made possible via ladders and/or other platforms on a drilling rig mast (not shown), to which the fingerboard assembly 105 may be attached by appropriately designed support members. As shown in FIG. 2*a*, lower support members 120, such as tubular shaped compression struts, may be attached to the drilling rig mast by lower connections 120*a*, whereas upper connections 121*a* may be attached to structural members 121 adjacent to and outboard of the two laterally opposing rows 108*a*, 108*b* (see FIG. 2*b*) of racking fingers 108.

In some embodiments disclosed herein, the rotatable diving board 111 may be substantially centrally located between the two laterally opposing rows 108*a*, 108*b* (see FIG. 2*b*) of racking fingers 108, thereby providing substantially unobstructed access to the racking fingers 108 as may be required during rig operations and/or maintenance activities. As illustrated in FIG. 2*a*, the diving board 111 may comprise structural support members 122, as well appropriately sized deck plates 130 on the upper surfaces thereof. In one illustrative embodiment, the structural support members 122 may be designed to support a remotely operated drill pipe handling device, such as a stand transfer vehicle 113, or STV. Depending on the overall pipe handling requirements, the STV 113 may be designed to travel below and along the length of the diving board 111, via an appropriately designed track or other conveyance system (not shown), which may be integral to or mounted on the structural support members 122. In certain embodiments, the STV 113 may be designed to grasp a stand of drill pipe from the pipehandler attached to the top drive assembly, rotate the stand left or right to an appropriate side of the diving board 111, transfer the stand down the length of the diving board 111 to an appropriate set of racking fingers 108, and move the stand between the racking fingers 108. In some embodiments, the pipe handling activities performed by the STV 113 may be controlled from a control panel 114, which may be operated by rig personnel stationed in an STV control pod 112. When not in use, the STV 113 may also be staged within an STV storage bay 113*b* located in the STV control pod 112, as shown in FIG. 2*a*.

Figure 2B:
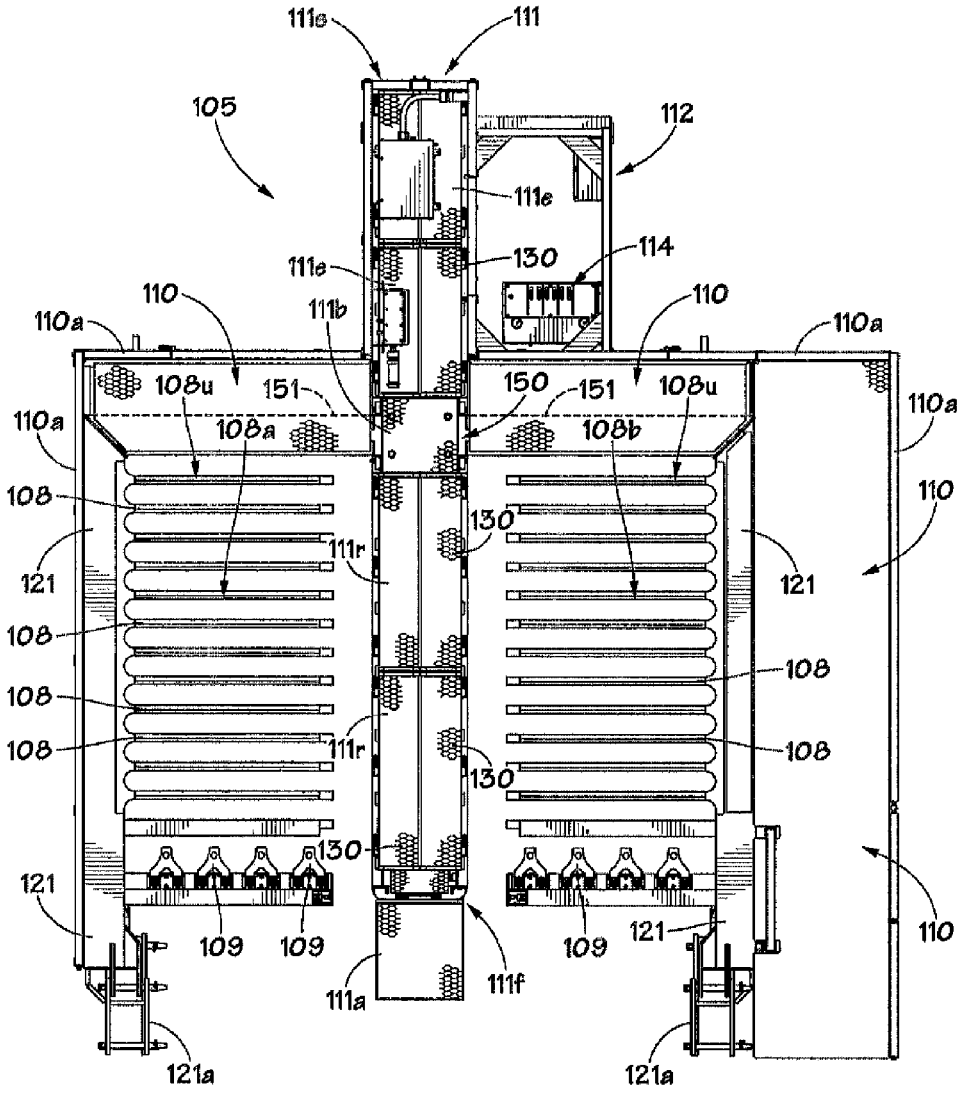
FIG. 2*b* is a plan view of the fingerboard and illustrative impact absorbing diving board shown in FIG. 2*a;*

FIG. 2*b* is a plan view of the fingerboard assembly 105 and the illustrative impact absorbing diving board 111. In the embodiment shown in FIG. 2*b*, a first end 111*f* of the diving board 111 may be located at the end proximate a drilling rig mast (not shown), whereas a second end 111*s* may be located at the opposite end of the diving board 111—i.e., at the end furthest from the drilling rig mast. Furthermore, the diving board 111 may comprise a diving board section 111*r* near the first end 111*f*, which may be substantially centrally located between laterally opposing rows 108*a*, 108*b* of racking fingers 108. In some illustrative embodiments, the diving board 111 may also comprise a hinged extension section 111*a* located at the first end 111*f* of the diving board 111. The hinged extension section 111*a* may, in some embodiments, comprise an appropriately designed deck plate 130 on the upper surface thereof. Furthermore, as may be necessary during some rig operations, the hinged extension section 111*a* may be folded out for closer access to the centerline of the well (as shown in FIG. 2*a*), or the hinged extension section 111*a* may be folded back to provide more clearance between the traveling block and/or top drive assembly and the diving board 111 during some rig operations (see, e.g., FIGS. 2*f* and 2*g*).

As shown in FIG. 2*b*, the diving board 111 may also comprise in some illustrative embodiments a diving board extension section 111*e* near the second end 111*s*, and which may in certain embodiments extend beyond the racking fingers 108 and access platforms 110, and away from drilling rig mast (not shown). The diving board extension section 111*e* may be designed to support and provide access to the STV control pod 112 and control panel 114, from which rig personnel may operate the STV 113. Furthermore, the diving board extension section 111*e* may also support the STV storage bay 113*b*, where the STV 113 may be staged when not in use. Additionally, and as with other sections of the diving board 111 and the access platforms 110, the upper surface of the diving board extension section 111*e* be covered by an appropriately designed deck plate 130, such as checkered plate, grating, expanded metal and the like. In some illustrative embodiments, structural support for the diving board extension section 111*e* may be accomplished by extending the length of the structural support members 122, such that the structural support members 122 run continuously for the full length of the diving board 111.

In some illustrative embodiments, the diving board 111 may also comprise a removable cover plate 111*b* located between the diving board extension section 111*e* and the diving board section 111*r* that is centrally positioned between the laterally opposing rows 108*a*, 108*b* of the racking fingers 108. In certain embodiments of the present disclosure, the removable cover plate 111*b* may comprise an appropriate deck plate 130, which may be removed to provide access to an impact absorbing diving board clamping assembly 150 (see FIG. 2*e*), details of which will be discussed below. In some embodiments, the clamping assembly 150 may be configured as a "pinned" connection about which the rotatable diving board 111 may be permitted to pivot under certain loading conditions, as will later be discussed in further detail. The clamping assembly 150 may be positioned between the diving board section 111*r* and the diving board extension section 111*e* such that the first end 111*f* of the diving board 111 is located inboard of the clamping assembly 150—i.e., closer to a drilling rig mast (not shown)—and the second end 111*s* is located outboard of the clamping assembly—i.e., farther from the drilling rig mast. Furthermore, it should be noted that in some embodiment of the present disclosure, the spacing from the first end 111*f* of the diving board 111 to the "pivot" point—i.e., to the clamping assembly 150—need not be equal to the spacing from the "pivot" point to the second end 111*s*. Moreover, in other embodiments, the clamping assembly 150 may be positioned within the fingerboard assembly 105 so as to avoid any interference with the racking fingers 108 and the pipe racking activities performed on or by the fingerboard assembly 105. For example, in certain illustrative embodiments, the clamping assembly 150 may be positioned outboard of the last racking finger 108*u* of the fingerboard assembly 105, as shown in FIG. 2*b*.

Figure 2C:
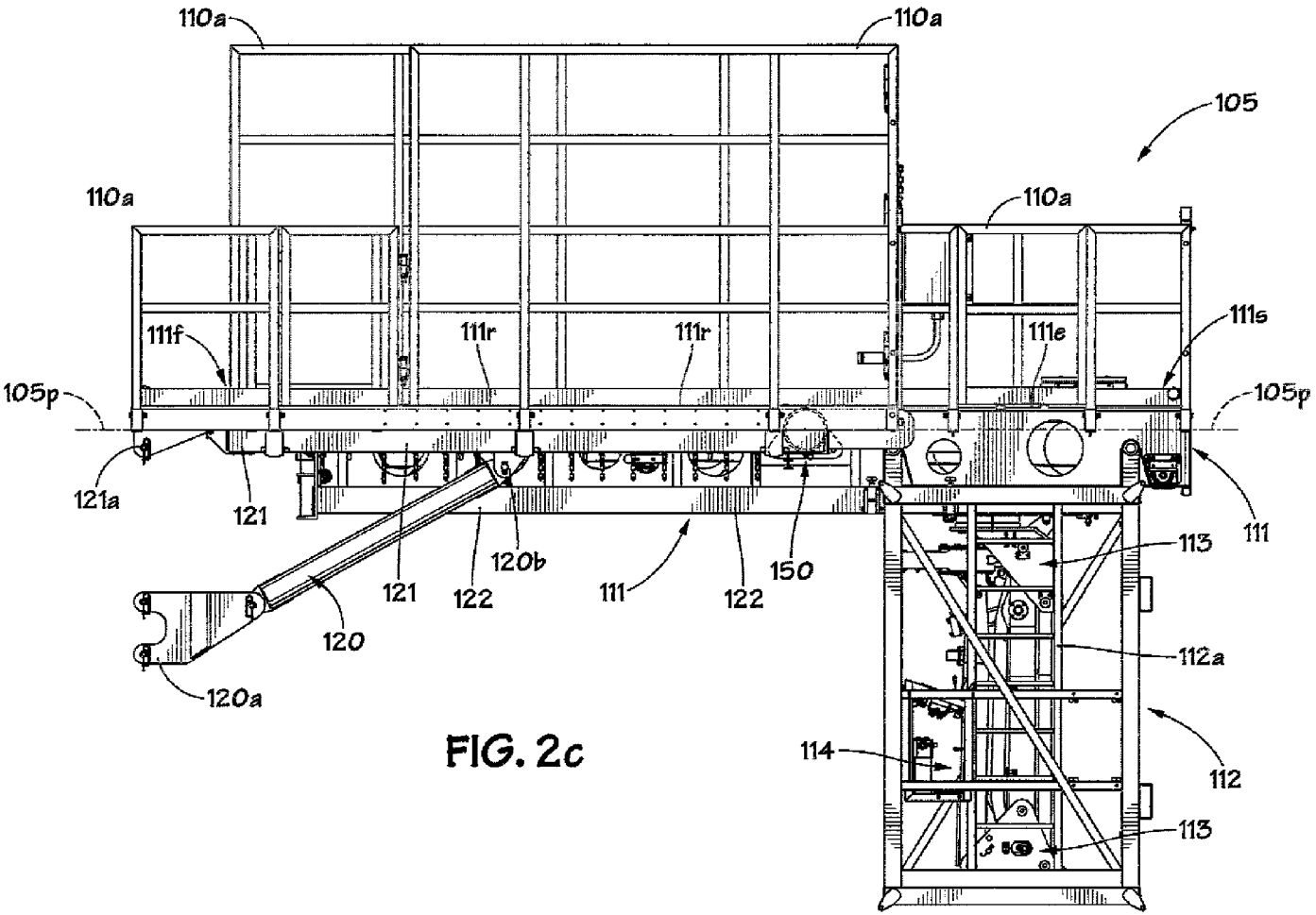
FIG. 2*c* is a side elevation view of the fingerboard and illustrative impact absorbing diving board shown in FIG. 2*b;*

FIG. 2*c* is a side elevation view of the fingerboard assembly 105 and the illustrative impact absorbing diving board 111 depicted in FIG. 2*b*. As shown in FIG. 2*c*, the lower support member 120 may be attached at its upper end to the structural member 121 by an appropriately designed connection 120*b*. FIG. 2*c* further depicts an illustrative embodiment wherein the STV 113, the STV control pod 112, and the control panel 114 are each supported below the diving board extension section 111*e*, from the diving board structural members 122. Additionally, access from the diving board extension section 111*e* to the STV control pod 112 and control panel 114 mounted therein may be accomplished by rig personnel via the ladder 112*a*. It should also be noted that in some embodiments of the present disclosure as shown in FIG. 2*c*, the diving board 111 maybe substantially aligned with and parallel to the plane 105*p* of the fingerboard assembly 105.

Figure 2D:
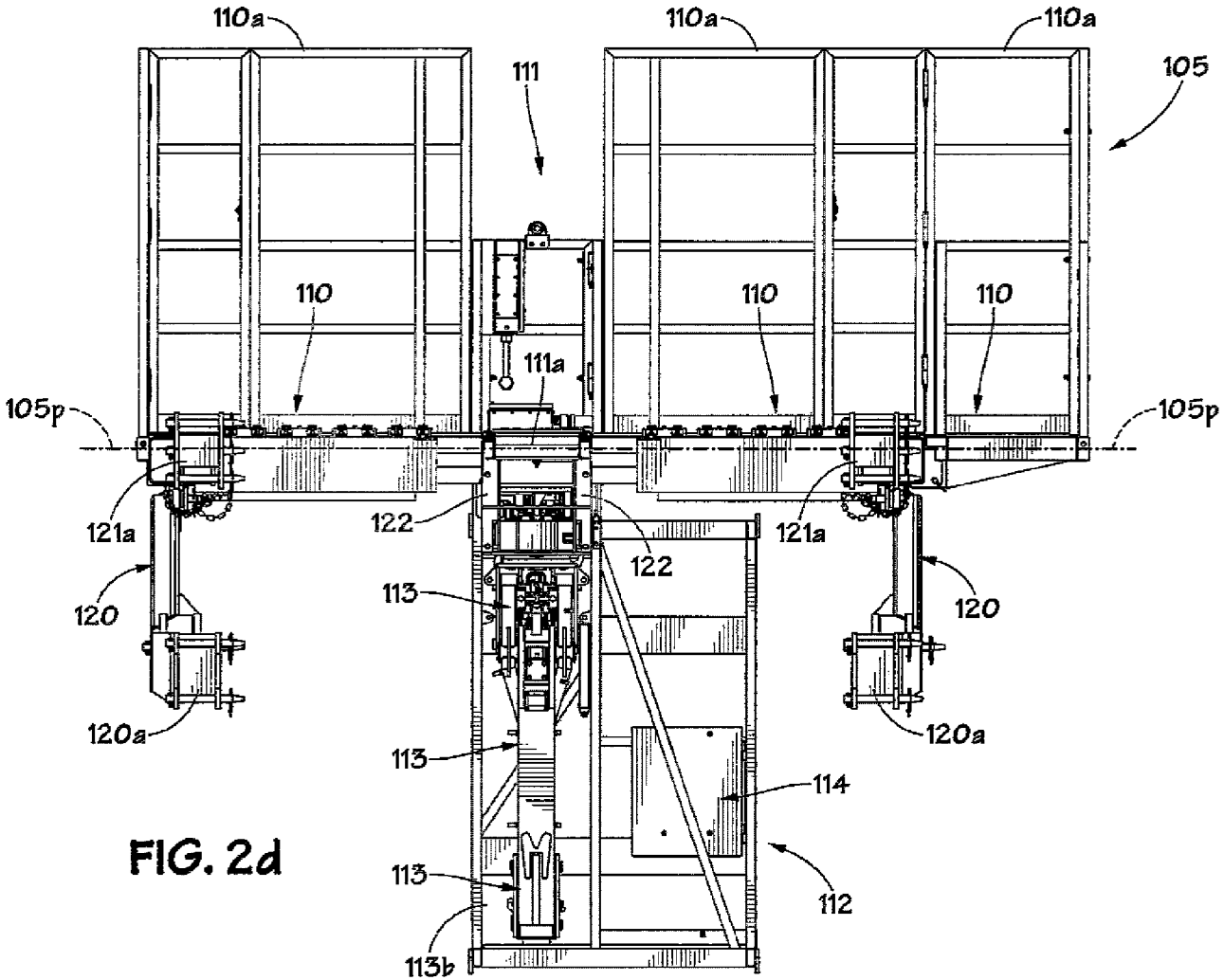
FIG. 2*d* is a front elevation view of the fingerboard and illustrative impact absorbing diving board shown in FIG. 2*b;*

FIG. 2*d* is a front elevation view of the fingerboard assembly 105 and the illustrative impact absorbing diving board 111 depicted in FIG. 2*b*. As shown in FIG. 2*d*, the STV 113 may be staged in the STV storage bay 113*b* when not in use. Furthermore, as with the STV control pod 112, the STV storage bay 113*b* may also be supported below the diving board extension section 111*e*, from the diving board structural support members 122.

As discussed above, the diving board 111 may inadvertently be struck near the first end 111*f* by a traveling block and/or top drive assembly (not shown) during the drill string tripping operations. Depending on the conditions of the strike, such as the speed at which the traveling block is moving and the mass of the equipment or material being moved, the impact load imparted to the diving board 111 may sometimes be quite large, which could result in significant damage to the diving board 111, the fingerboard assembly 105, and/or other ancillary equipment, such as the STV 113. In order to avoid, or at least minimize, the type of damage that may occur as a result of an inadvertent diving board strike, the design of the diving board 111 may, in some illustrative embodiments, incorporate an impact absorbing diving board clamping assembly 150 (see FIGS. 2*b*-2*c*) about which the diving board 111 may pivot in the event of such a diving board strike.

Figure 2E:
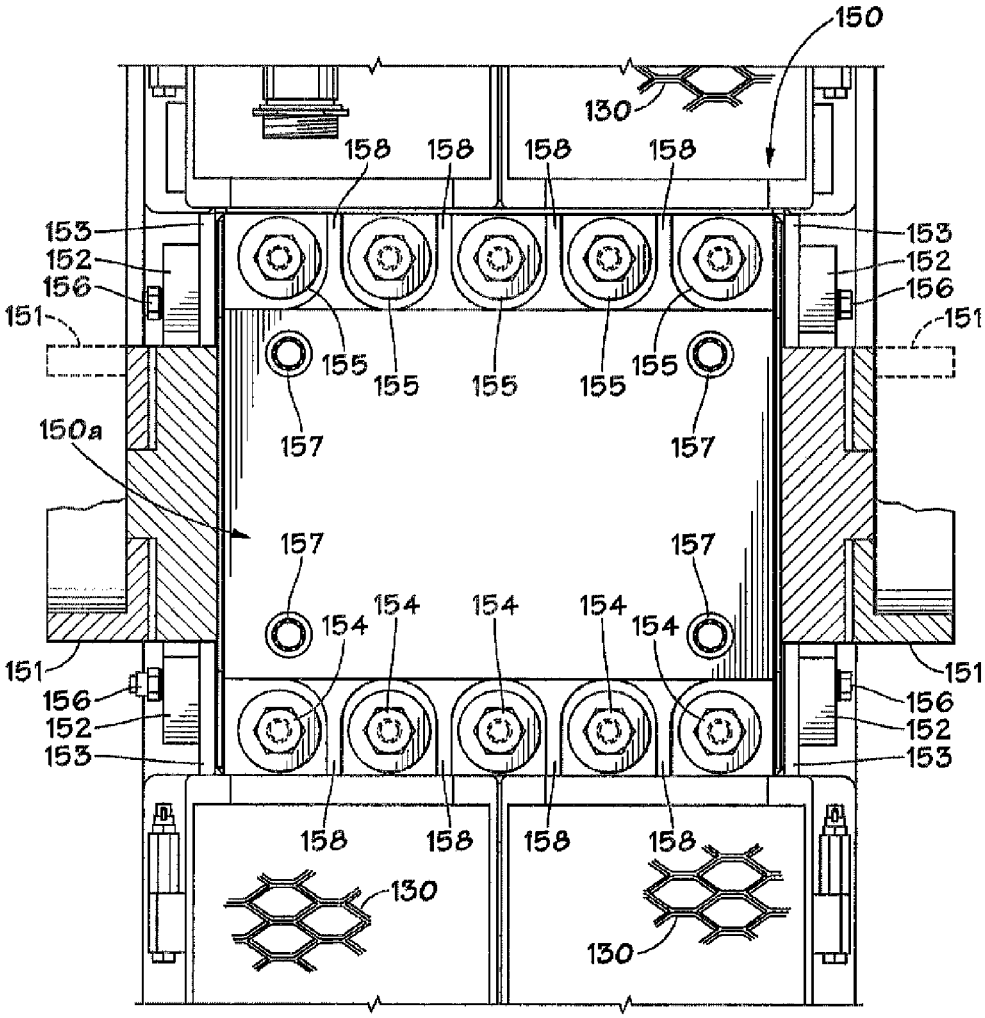
FIG. 2*e* is a plan view of an illustrative impact absorbing diving board clamping assembly of the present disclosure.

FIG. 2*e* is a plan view of one illustrative embodiment of an impact absorbing diving board clamping assembly 150 according to the present disclosure. In some embodiments, the clamping assembly 150 may comprise an upper clamp section 150*a*, a lower clamp section 150*b* (see FIGS. 2*f*-2*h*), and a plurality of fasteners 154 for clamping the upper and lower clamp sections 150*a*, 150*b* together. In certain embodiments, the upper and lower clamp sections 150*a*, 150*b* may comprise, for example, structural grade or high strength carbon steel, low allow steel, and the like, and may further be fabricated from one of any number suitable material product form, such as bars, plates forgings, castings, and the like. Also as shown in FIG. 2*e*, the clamping assembly 150 may also comprise side plates 153 (see also FIGS. 2*f* and 2*g*) on laterally opposing sides of the upper and lower clamp sections 150*a*, 150*b*. In particular embodiments, the side plates 153 may comprise, for example, structural grade carbon steel, such as A36 and the like, whereas in other embodiments the side plates 153 may comprise high strength carbon steel or low allow plates. Generally, the thickness of these various components may be determined depending on the anticipated loading conditions during normal rig operations, as well as when the diving board 111 is subjected to an inadvertent diving board strike, as will be described in further detail below.

In some illustrative embodiments disclosed herein, the fasteners 154 may be suitably sized threaded fasteners, such as, for example, hex head bolts, machine screws, threaded studs, and the like. Furthermore, the size and material grade of fasteners 154 may be selected as necessary for the required fastener pre-load as discussed below, as well as the anticipated loading conditions during operation. For example, in certain embodiments, the threaded fasteners 154 may be 1½-8UN heavy hex head shoulder bolts, and may comprise a high strength material grade, such as A325, A490, Gr.8, and the like, although other sizes and material types may also be used. In particular embodiments, each of the fasteners 154 may pass through a corresponding hole in the upper clamp section 150*a* so as to engage a blind hole at a corresponding location in the lower clamp section 150*b*. In those embodiments wherein the fasteners 154 comprise threaded fasteners, the blind hole at each corresponding location in the lower clamp section 150*b* may be tapped and internally threaded with a thread type and size to match that of the threaded fasteners 154.

In some illustrative embodiments, a plurality of tension indicating washers 155 may be used in conjunction with each fastener 154 so as to ensure that a specific pre-load is maintained on each fastener during the normal operation of the diving board 111 and the impact absorbing diving board clamping assembly 150. For those embodiments of the present disclosure wherein the fasteners 154 may be heavy hex head shoulder bolts, the shoulder bolt fasteners 154 may be sized to impart a predetermined amount of compression to the plurality of tension indicating washers 155, thereby achieving the desired fastener pre-load without requiring a specific bolt torque setting. In other illustrative embodiments, the upper and lower clamp sections 150*a*, 150*b* may be coupled together using traditional a "through-bolting" technique, where the fasteners 154 may be threadingly coupled to a corresponding appropriately threaded nut (not shown). However, when utilizing the above-described "through-bolting" technique, control of the bolt torque used to make up the clamping assembly 150 during initial assembly may be required so as to achieve the desired pre-load. As shown in FIG. 2*e*, the upper clamp section 150*a* may further comprise a rib or gusset 158 disposed between each of the fasteners 154 so as to provide additional stiffness at each fastener location.

In particular embodiments, a plurality of fasteners (not shown) may be used to facilitate the installation and removal of the removable cover plate 111*b* (see FIGS. 2*a* and 2*b*). In such embodiments, each of the plurality of fasteners (not shown) may pass through a corresponding hole in the removable cover plate 111*b* so as to engage a blind hole 157 at a corresponding location in the upper clamp section 150*a*. In those embodiments wherein the fasteners used to attach the removable cover plate 111*b* to the clamping assembly 150 comprise threaded fasteners, the blind holes 157 at the corresponding fastener locations in the upper clamp section 150*a* may be tapped and threaded with a thread type and size to match that of the threaded fasteners.

In certain illustrative embodiments of the present disclosure, the upper and lower clamp sections 150*a*, 150*b* are adapted to engage with and clamp around a cylindrically shaped structural member 151 passing therebetween. Depending on the overall design requirements and anticipated loading criteria, the cylindrically shaped structural member 151 may be a hollow structural element, such as, for example, a section of pipe or mechanical tubing. In some embodiments, the cylindrically shaped structural member 151 may be, for example, a 10" O.D. by ½" wall thickness mechanical tubing, and may comprise carbon steel or low alloy steel material. For example, and depending on the anticipated loading and strength requirements, in certain illustrative embodiments the cylindrically shaped structural member 151 may comprise a hot-finished drawn-over-mandrel (HF DOM) mechanical tubing using carbon steel materials manufactured to ASTM 1010, 1015, 1018, 1020, 1026, and/or 1035 standards, and the like. Other tubing sizes and material grades may also be used. Furthermore, the cylindrically shaped structural member 151 may extend substantially across the width of the fingerboard assembly 105, and may be fixedly attached in any suitable fashion, such as by welding and the like, to the structural members 121 adjacent to and outboard of the two laterally opposing rows 108*a*, 108*b* (see FIG. 2*b*) of racking fingers 108. The clamping assembly 150 may thereby, under some circumstances, be permitted to rotate about the fixed cylindrically shaped structural member 151, as will be further discussed in additional detail below.

In certain embodiments, shear plates 152 may be fixedly attached, such as by welding and the like, to the cylindrically shaped structural member 151 immediately adjacent to and outboard of the side plates 153. Furthermore, as shown in FIG. 2*e*, shear pins 156 may be inserted into correspondingly aligned holes in the shear plates 152 and the clamping assembly 150 such that the shear pins 156 extend continuously through both shear plates 152, both side plates 153, and the lower clamp section 150*b*. In particular embodiments, the shear pins 156 may comprise, for example, threaded fasteners, such as hex head bolts, or fully or partially threaded studs, and the like. For example, in one embodiment, the shear pins 156 may be ⅝"-11 UNC heavy hex head bolts secured with corresponding heavy hex nuts, and may be made of A449 Gr.5 material. Depending on the anticipated loading parameters, other shear pin sizes and/or material grades may also be used.

Figure 2F:
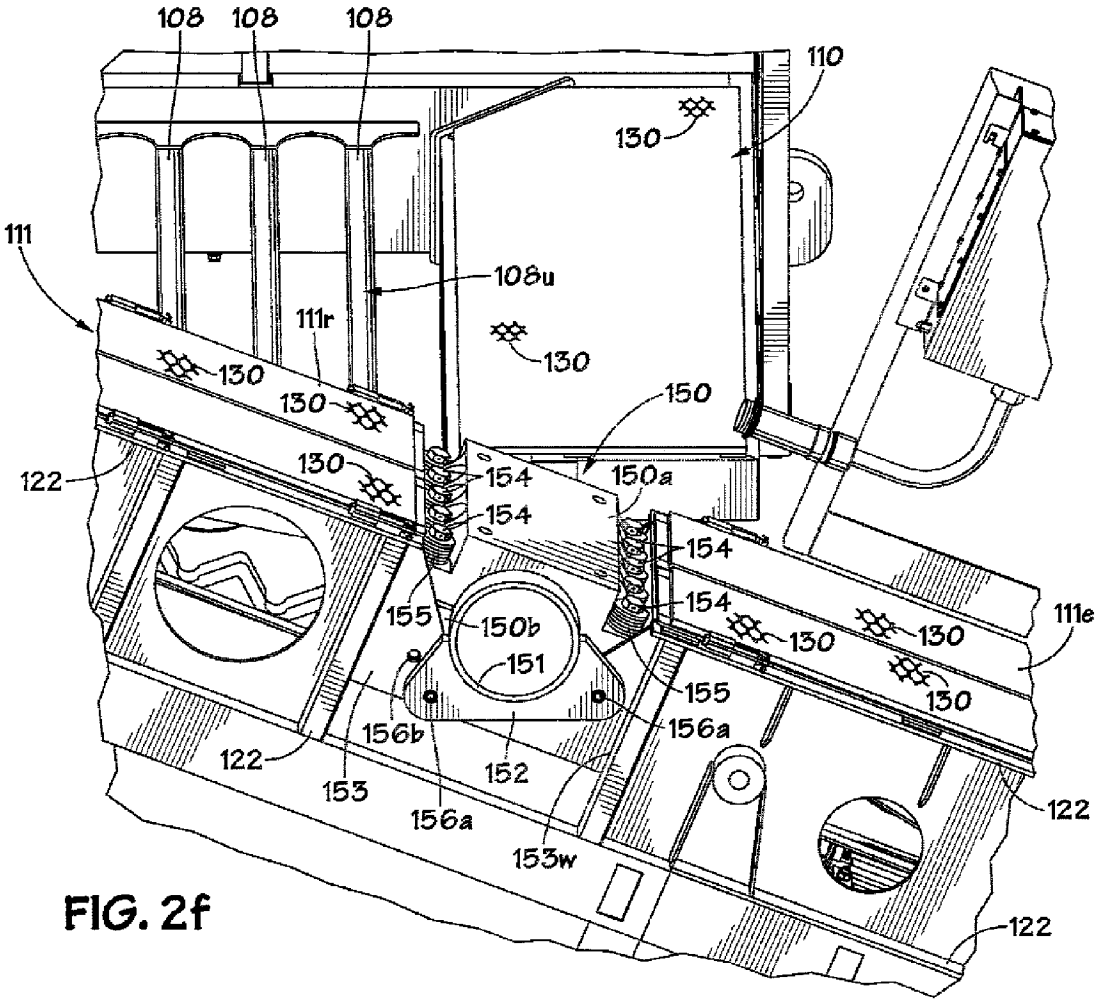
FIG. 2*f* is an isometric view of the illustrative impact absorbing diving board clamping assembly shown in FIG. 2*e*, after an impact from below.
Figure 2G:
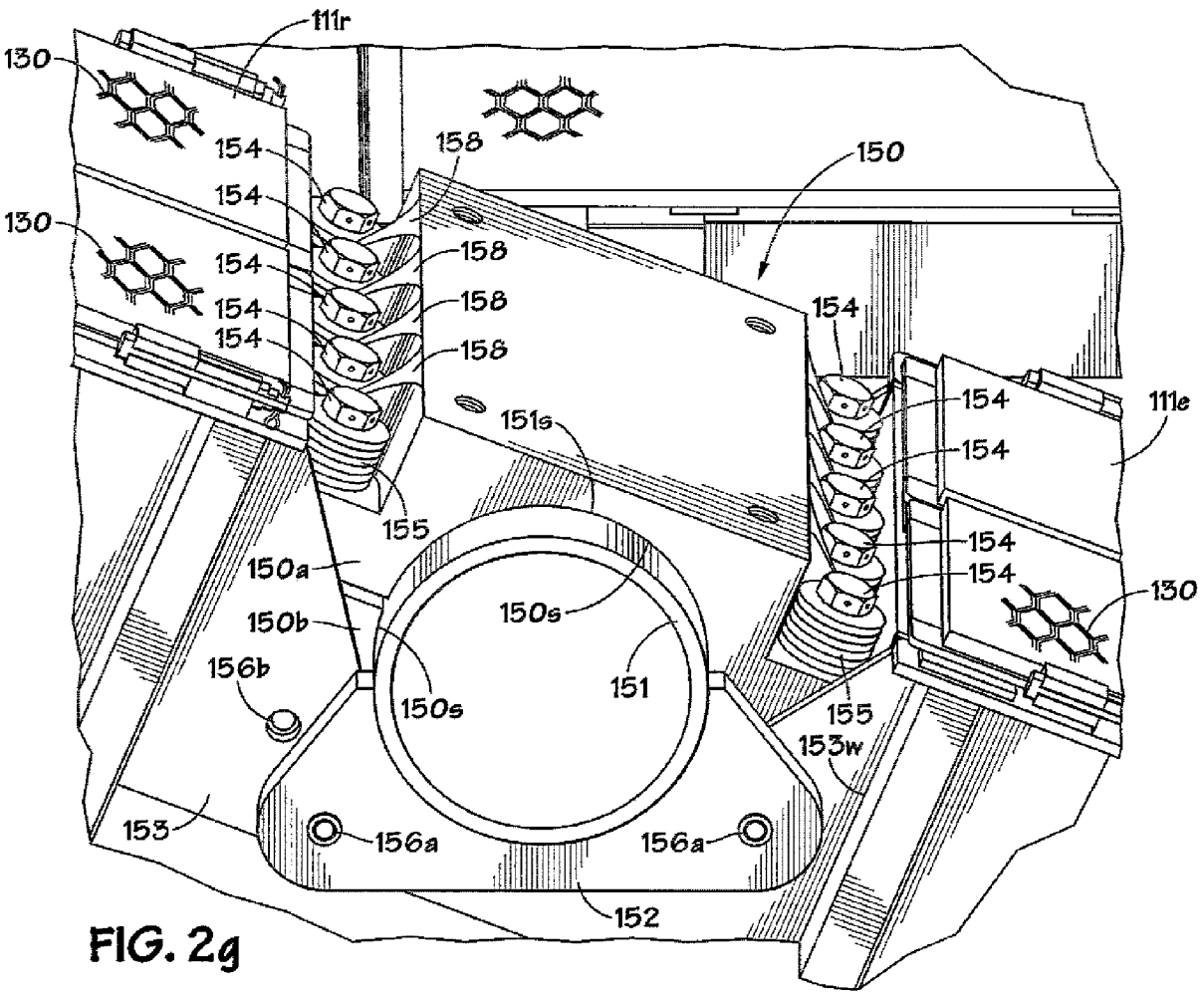
FIG. 2*g* is a close-up isometric view of the illustrative impact absorbing diving board clamping assembly shown in FIG. 2*e*, after an impact from below.

FIG. 2*f* is an isometric view of the illustrative impact absorbing diving board clamping assembly 150 shown in FIG. 2*e*, and FIG. 2*g* provides additional close-up detail of the isometric view of FIG. 2*f*. Furthermore, the clamping assembly 150 and diving board 111 depicted in FIGS. 2*f* and 2*g* are shown in a rotated position, which may be representative of the positions of the clamping assembly 150 and diving board 111 relative to the fingerboard assembly 105 after the diving board 111 has been struck near the first end 111*f* from below by a traveling block and/or top drive assembly of a drilling rig. Also, as noted previously, in certain illustrative embodiments of the present disclosure, the cylindrically shaped structural member 151 may extend substantially across the width of the fingerboard assembly 105, and may be fixedly attached to the structural members 121. However, for clarity of detail, the cylindrically shaped structural member 151 depicted in FIGS. 2*f* and 2*g* has been truncated at the shear plates 152.

As shown in FIGS. 2*f* and 2*g*, the shear plates 152 may comprise holes 156*a*, and the side plates 153 may comprise holes 156*b*. As noted previously, during normal rig operations, the holes 156*a* in the shear plates 152 would be aligned with the holes 156*b* in the side plates 153, and the shear pins 156 (see, FIG. 2*e*) would pass through both holes 156*a*, 156*b* when initially installed. Also as shown in FIGS. 2*f* and 2*g*, the side plates 153 may be fixedly attached to the structural support members 122, such as by a weld 153*w* and the like, which may thereby make the structural support members 122 of the diving board 111 structurally "continuous" between the diving board section 111*r* and the diving board extension section 111*e*.

As shown in FIG. 2*g*, the inside clamping surfaces 150*s* of the upper and lower clamp sections 150*a*, 150*b* may be formed, such as by machining or milling and the like, so as to substantially conform to the curvature of the outside surface 151*s* of cylindrically shaped structural member 151. This curved clamping surface 150*s* may thus enable a substantially uniform clamping force between the clamping assembly 150 and the outside surface 151*s* of the cylindrically shaped structural member 151. Furthermore, these substantially conforming surfaces 150*s*, 151*s* may also enable the clamping assembly 150 and diving board 111 to rotate, under certain circumstances, around the cylindrically shaped structural member 151. In some illustrative embodiments, the clamping surfaces 150*s* of both the upper and lower clamp sections 150*a*, 150*b* may also be exposed to a suitable surface treatment, such as nitriding or carburizing and the like, so as to increase the surface hardness of the clamping surfaces 150*s*, which may thereby reduce the likelihood that galling may occur when the clamping assembly 150 rotates relative to the cylindrically shaped structural member 151 under a high clamping force. Additionally, the surface treatment may serve to facilitate a more uniform and stable surface finish of the clamping surface 150*s*, a consequence of which may be a more uniform coefficient of friction between the clamping surfaces 150*s* and the outside surface 151*s* of the cylindrically shaped structural member 151.

Figure 2H:
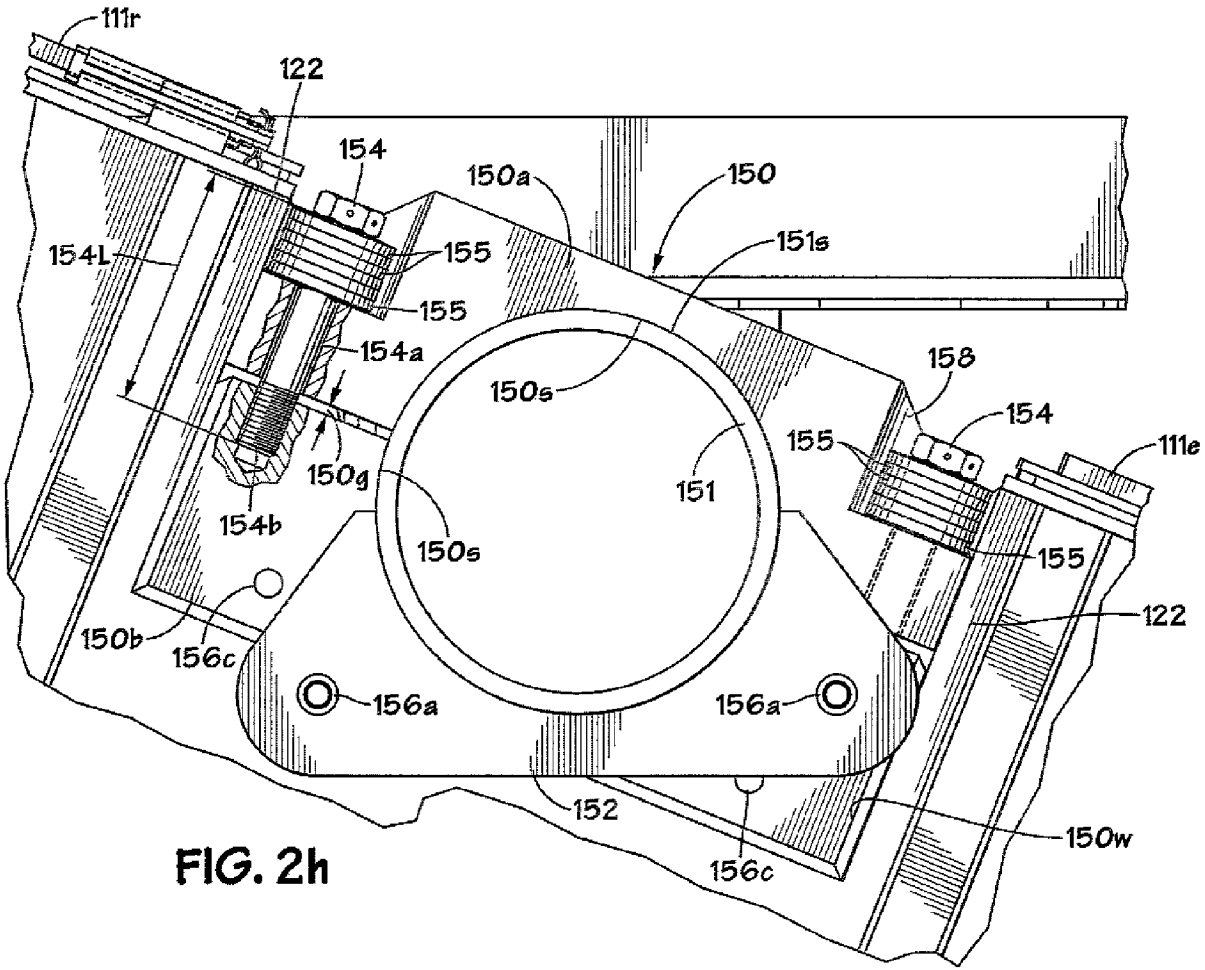
FIG. 2*h* is a close-up side elevation view of the illustrative impact absorbing diving board clamping assembly shown in FIG. 2*e*, after an impact from below.

FIG. 2*h* is a side elevation view of the illustrative impact absorbing diving board clamping assembly 150 shown in FIG. 2*e*, wherein the side plate 153 has been removed for clarity. As with FIGS. 2*f* and 2*g*, the clamping assembly 150 and diving board 111 depicted in FIGS. 2*f* and 2*g* are shown in a rotated position, as may occur after the diving board 111 has been struck near the first end 111*f* from below by a traveling block and/or top drive assembly of a drilling rig. As shown in FIG. 2*h*, the lower clamp section 150*b* may comprise holes 156*c* which may be located to align with the holes 156*a* of the shear plates 152 and the holes 156*b* of the side plates 153 (not shown in FIG. 2*h*) so that the shear pins 156 may be installed so as to pass continuously through the entire clamping assembly 150. In some illustrative embodiments, the lower clamp section 150*b* may also be fixedly attached to the structural support members 122, such as by a weld 150*w* and the like, which may thereby, in conjunction with the fixedly attached side plates 153, make the structural support members 122 of the diving board 111 structurally "continuous" between the diving board section 111*r* and the diving board extension section 111*e*.

As noted previously, in some illustrative embodiments, the fasteners 154 may be threaded fasteners, such as heavy hex head bolts and the like, which may pass through corresponding holes 154*a* in the upper clamp section 150*a* so as to engage internally threaded blind holes 154*b* at a corresponding location in the lower clamp section 150*b*. In particular embodiments of the present disclosure, the length 154L of the threaded fasteners 154—such as shoulder bolts, and the like—may be adjusted such that each of the threaded fastener 154 bottoms out when threaded into the respective threaded blind holes 154*b*, thereby leaving a space or gap 150*g* as shown in FIG. 2*h* between the upper clamp section 150*a* and the lower clamp section 150*b*. Furthermore, in some embodiments, the quantity, size, material, and/or spring rate of the tension indicating washers 155 used at each fastener 154 location may also be adjusted, together with the fastener length 154L, so as to ensure that the required gap 150*g* and fastener pre-load are maintained during the normal operation of the diving board 111 and the impact absorbing diving board clamping assembly 150. In this manner, the total amount of clamping force imparted by the clamping assembly 150 to the cylindrically shaped structural member 151 may be controlled to such a level that may permit the clamping assembly 150 and the diving board 111 to rotate under certain circumstances, such as when the diving board 111 may be inadvertently impacted by a traveling block and/or top drive assembly during rig operations, while still maintaining sufficient clamping force to arrest, or "brake," the rotational movement of the diving board 111 after the initial impact has occurred.

The overall function of the impact absorbing diving board clamping assembly 150 will now be discussed in detail below.

Figure 2I:
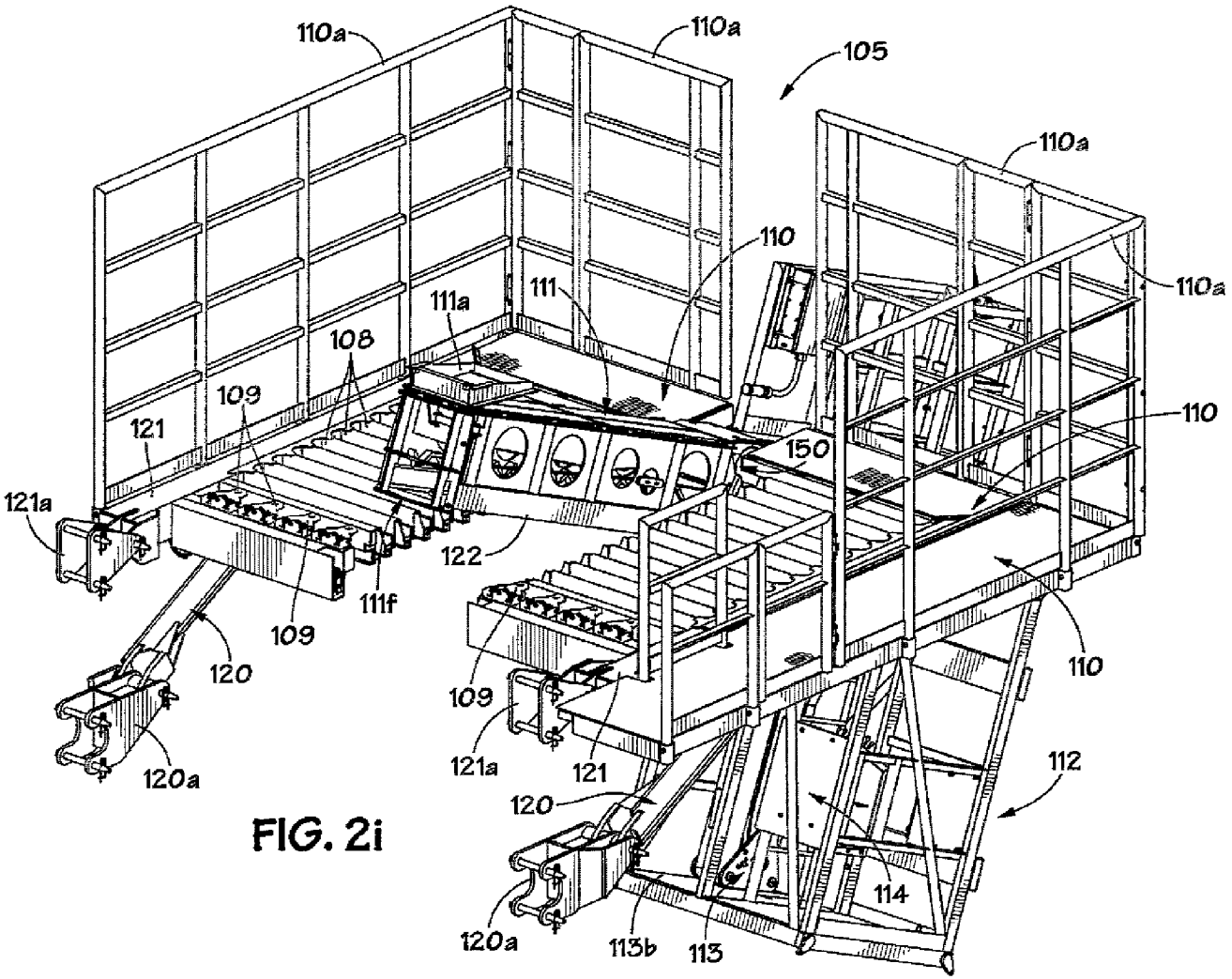
FIG. 2*i* is an isometric view of the fingerboard and illustrative impact absorbing diving board shown in FIG. 2*a*, after an impact from below.
Figure 2J:
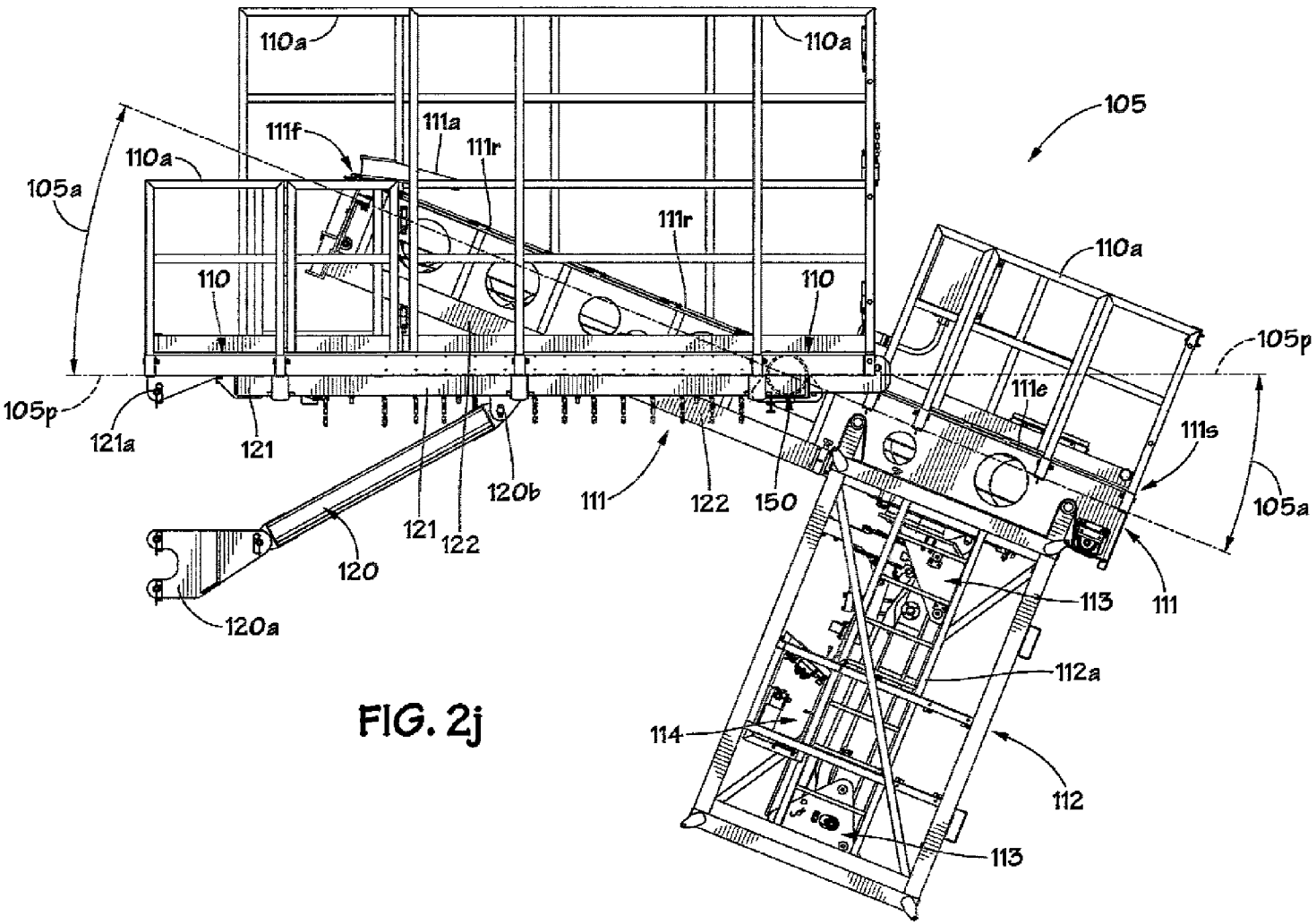
FIG. 2*j* is a side elevation view of the fingerboard and illustrative impact absorbing diving board shown in FIGS. 2*a* and 2*c*, after an impact from below.
Figure 2K:
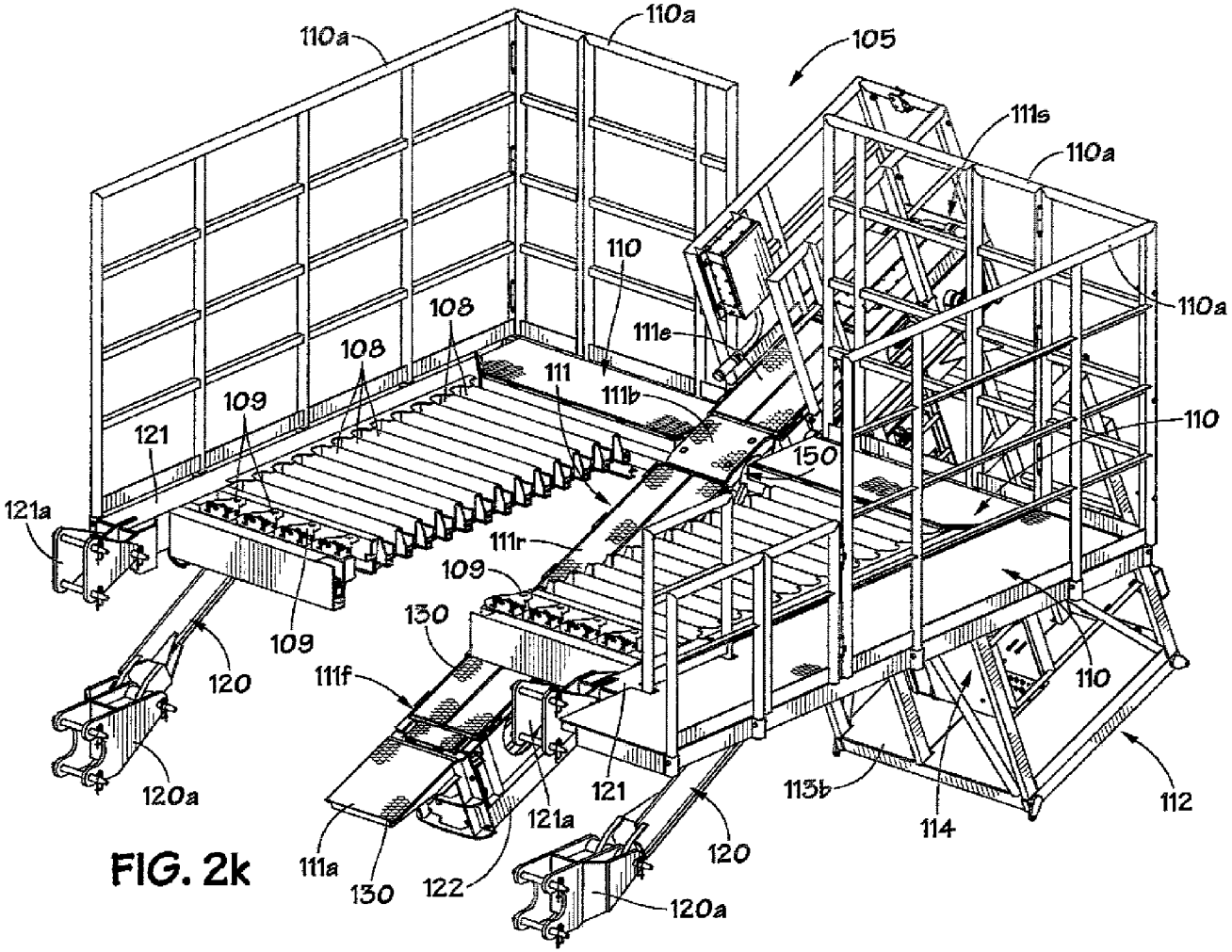
FIG. 2*k* is an isometric view of the illustrative impact absorbing diving board shown in FIG. 2*a*, after an impact from above.

FIGS. 2*i*-2*k* show the fingerboard assembly 105 and an illustrative embodiment of the impact absorbing diving board 111 of the present disclosure after the diving board 111 may have been inadvertently struck near the first end 111*f* by a traveling block and/or top drive assembly during drilling rig operations. More specifically, FIGS. 2*i* and 2*j* show the impact absorbing diving board 111 after being struck from below—FIG. 2*i* being an isometric view and FIG. 2*j* being a side elevation view—whereas FIG. 2*k* is an isometric view of the fingerboard assembly 105 and impact absorbing diving board 111 after the diving board 111 has been struck from above. As shown in FIGS. 2*i* and 2*j*, after being struck near the first end 111*f* from below by the traveling block and/or top drive assembly, the impact absorbing diving board 111 may pivot or rotate about the clamping assembly 150, so that the first end 111*f* and the diving board section 111*r* between the rows 108*a*, 108*b* of racking fingers 108 may rotate upward from the plane 105*p* (see FIGS. 2*c* and 2*j*) of the fingerboard assembly 105, whereas the second end 111*s* and the diving board extension section 111*e* supporting the STV control pod 112 may rotate downward from the plane 105*p*.

As noted previously, during the initial assembly of the impact absorbing diving board clamping assembly 150, the shear pins 156 (see FIG. 2*e*) are installed in the clamping assembly 150 by inserting the shear pins 156 through the holes 156*a*, 156*b* and 156*c* of the shear plates 152, the side plates 153, and the lower clamp section 150*b*, respectively. In some illustrative embodiments, the shear pins 156 are preferably installed with the holes 156*a*, 156*b* and 156*c* aligned such a manner that the impact absorbing diving board 111 may be substantially aligned with and parallel to the plane 105*p* (see FIG. 2*c*) of the fingerboard assembly 105—i.e., in a horizontal plane—thereby permitting access by rig personnel along the length of the diving board 111 during normal rig operations. Furthermore, in certain illustrative embodiments as discussed above, during the initial assembly of the clamping assembly 150, the plurality of fasteners 154 may be used to impart a clamping force between the upper and lower clamp sections 150*a*, 150*b* and the cylindrically shaped structural member 151.

Accordingly, the shear strength of the shear pins 156, in combination with the static friction force generated by the clamping force between the upper and lower clamp sections 150*a*, 150*b* and the cylindrically shaped structural member 151, should be of sufficient magnitude to resist the moment loads on the clamping assembly 150 that may be anticipated during normal rig operations. In some illustrative embodiments, the normal operating moment loads on the clamping assembly 150 may include, for example, dead load moments caused by the dead weight of the diving board 111 (including the structural support members 122), the dead weight of the STV control pod 112 (including the control panel 114 and STV storage bay 113*b*), the dead weight of the STV 113, and the dead weight of any ancillary equipment associated with the operation of the STV 113—such as tracks, drive motors, controls and the like—that may be mounted on or attached to the diving board 111 and/or the structural support member 122. The normal operating moment loads on the clamping assembly 150 may also include, for example, live load moments caused by personnel, equipment, and/or materials present on the impact absorbing diving board 111 during rig operations, as well as, for example, dynamic load moments caused by movement of the STV 113 during pipe handling operations.

On the other hand, in order for the impact absorbing diving board 111 to be able to pivot or rotate about the clamping assembly 150 after being impacted from above or below by a traveling block and/or top drive assembly of a drilling rig, the combined shear strength of the shear pins 156 and static friction force imparted by the clamping assembly 150 on the cylindrically shaped structural member 151 must be overcome by the additional dynamic moment that is created when the diving board 111 is struck near the first end 111*f*. Furthermore, in order to protect the diving board 111, the automatic pipe handling system, and/or the fingerboard assembly 105 from incurring undue damage during such an event, the magnitude of the combined shear strength and static friction force discussed above should be low enough so that the shear pins 156 are sheared and the friction force on the cylindrically shaped structural member 151 is overcome when the diving board 111 is struck.

Accordingly, in particular embodiments disclosed herein, the size, material, and mechanical properties of the shear pins 156, and the amount of pre-load imparted to the fasteners 154 during initial assembly of the clamping assembly 150 (and the commensurate clamping force on the cylindrically shaped structural member 151), may each be adjusted so as to hold the clamping assembly 150 and the diving board 111 in a substantially horizontal orientation under normal rig operations and loading conditions, while also permitting the diving board 111 to rotate or pivot about the clamping assembly 150 in certain instances when the diving board 111 may be inadvertently impacted by a traveling block and/or top drive assembly during pipe handling operations. In yet other embodiments, the shear strength of the shear pins 156 and the static friction force on the cylindrically shaped structural member 151 may be further adjusted so that the diving board 111 is permitted to rotate or pivot about the clamping assembly 150 only in those circumstances when the magnitude of any impact load on the diving board 111 exceeds a value that is known to cause an unacceptably high level of damage to a diving board assembly (or to its associated pipe handling accessories and components) that does not otherwise comprise a clamping assembly, such as a clamping assembly 150 of the present disclosure.

It should be noted that, after the occurrence of an impact load event that may cause the impact absorbing diving board 111 to rotate or pivot about the clamping assembly 150 as described above—i.e., wherein the shear pins 156 are sheared and the friction force on the cylindrically shaped structural member 151 is overcome—the friction force should still be of such a magnitude as to be able to hold the diving board in its rotated position. That is, the friction force between the clamp assembly 150 and the cylindrically shaped structural member 151 should be sufficiently high enough to eventually overcome any residual angular momentum imparted to the diving board 111 by a traveling block and/or top drive assembly after the shear pins 156 have been sheared, so as to stop the rotational movement of the diving board 111. Once the rotational movement of the diving board 111 has been stopped, the friction force should be also be sufficiently high enough to resist at least the dead load moments described above, as well as any live load moments that may also be present. In this manner, the clamping assembly 150 acts as a "brake," thereby preventing the impact absorbing diving board 111 from swinging freely up and/or down, which, if permitted, may under some circumstances cause additional impact loading on, and subsequent damage to, the diving board 111, the clamping assembly 150, and/or the fingerboard assembly 105, including the racking fingers 108. It should be further noted that the "braking" effect caused by the frictional force of the clamping assembly 150 may be of added importance in those embodiments wherein the diving board 111 comprises an automatic and/or remotely controlled pipe handling system, due to the significant amount of additional dead weight of (and the subsequent additional moment loads caused by) the materials and equipment of such a system, such as, for example, the diving board extension section 111*e*, the STV 113, the STV control pod 112, the control panel 114, and the like.

Depending on the magnitude of the impact load imparted to the impact absorbing diving board 111 when struck near the first end 111*f* by a traveling block and/or top drive assembly, the diving board 111 may rotate about the clamping assembly 150 at an angle 105*a* (see FIG. 2*j*) of approximately 15-20°, or even higher. For example, when properly controlled as discussed herein, in some illustrative embodiments the diving board 111 may rotate by as much as 90° in either direction, depending on whether the traveling block and/or top drive assembly is moving up or down when it strikes the diving board 111 from below or above. The amount of angular rotation may be controlled by several factors, including, among other things: the size and strength of the shear pins 156; the size of the cylindrically shaped structural member 151; the contact length, contact arc and coefficient of friction between the cylindrically shaped structural member 151 and the clamp assembly 150; the amount of pre-load imparted to each of the fasteners 154 during initial assembly; the total number of fasteners 154; and the distribution of equipment and/or other dead load components over the length of the diving board 111. Furthermore, the amount of angular rotation, e.g., angle 105*a*, may also depend on how long it takes rig personnel to set the draw works brake, which thereby stops the movement of the traveling block and/or top drive assembly.

In the event of an impact load occurrence that is of sufficient magnitude to cause the impact absorbing diving board 111 to rotate, the diving board 111 may be returned to its normal—i.e., substantially horizontal—operating position, and the clamping assembly 150 may be re-set in accordance with the following procedure. First, measures must be taken to support the dead weight of the diving board 111, including the dead weight of any additional or ancillary equipment and materials mounted on or attached to the diving board 111, such as the STV 113, the STV control pod 112, and the like. For example, the wire rope of an air hoist, or tugger, may be sheaved through the crown of the drilling rig and attached to one end of the diving board 111 so as to be able to support the dead load once the "braking" effect of the clamping assembly 150 has been eliminated. Depending on the dead weight distribution along the length of the diving board 111, and the specific location of the clamping assembly 150 relative to each end of the diving board 111, the dead load may be supported at the first end 111*f* of the diving board 111 proximate the drilling rig mast, or it may be supported at the second end 111*s* of the diving board 111 opposite the drilling rig mast.

Next, the pre-load on each of the plurality of fasteners 154 may be reduced so that the static friction force on the cylindrically shaped structural member 151 may be reduced, and the "braking" effect of the clamping assembly 150 may be effectively eliminated. For example, if the fasteners 154 are threaded fasteners, the threaded fasteners 154 may be sufficiently loosened to reduce the clamping force imparted on the cylindrically shaped structural member 151 by the upper and lower clamp sections 150*a*, 150*b* to a point where the dead load moments on the clamping assembly 150 are greater than the static friction force on the cylindrically shaped structural member 151.

Once the "braking" effect of the clamping assembly 150 has been eliminated, and the dead weight of the diving board 111 (and that of any ancillary materials and equipment) is supported by the wire rope and tugger, the tugger may then be used to lower the diving board 111 until the holes 156*a*, 156*b* and 156*c* of the shear plates 152, the side plates 153, and the lower clamp section 150*b*, respectively, are substantially aligned. Furthermore, the diving board 111 may at this point be substantially aligned with and parallel to the plane 105*p* (see FIGS. 2*c* and 2*j*) of the fingerboard assembly 105—i.e., substantially horizontal. Thereafter, any remnants of the shear pins 156 remaining in the clamping assembly 150 may be removed, and new shear pins 156 may then be installed, as outlined above. Finally, each of the plurality of fasteners 154 may be pre-loaded in the manner previously discussed, and the dead load of the diving board 111 and that of any other associated materials and equipment may be removed from the tugger.

As a result, the subject matter of the present disclosure provides details of various aspects of impact load absorbing diving board assemblies that may be used in conjunction with the vertical pipe racking systems of portable land-based drilling rigs. Additionally, the present disclosure is also directed to methods of operating the various embodiments of impact absorbing diving board assemblies disclosed herein. Furthermore, while the embodiments outlined in the present disclosure may be specifically directed to assemblies and methods that comprise automatic and/or remotely operated pipe handling systems for portable land-based drilling rigs, the concepts disclosed herein may be equally applicable to vertical pipe racking systems that employ substantially manual pipe handling operations—e.g., wherein automatic and/or remotely operated pipe handling systems are not utilized—as well as to non-portable land-based drilling rigs and/or offshore drilling applications.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A diving board assembly of a drilling rig fingerboard assembly, said diving board assembly comprising:

a first end proximate said drilling rig;

a second end positioned remote from said first end, wherein said first end is more proximal to said drilling rig than said second end;

a clamping assembly operatively coupled to said first end and said second end, wherein said clamping assembly is positioned between said first and second ends and defines a pinned connection that is adapted to permit a rotation of said first and second ends relative to a plane defined by said fingerboard assembly when an impact load is imparted to said first end, said clamping assembly being further adapted to brake said rotation of said first and second ends and hold said diving board assembly at a fixed angle relative to said plane defined by said fingerboard assembly.

2. The diving board assembly of claim 1, wherein said plane defined by said fingerboard assembly is substantially horizontal.

3. The diving board assembly of claim 1, wherein said clamping assembly is operatively coupled to said first and second ends by at least one structural support member.

4. A pipe racking system of a drilling rig, comprising:

a fingerboard assembly adapted for staging one or more sections of pipe in a substantially vertical orientation, wherein at least a portion of said fingerboard assembly is positioned in a substantially horizontal plane and comprises two laterally opposing rows of racking fingers;

a pivotable diving board assembly substantially disposed between said two laterally opposing rows of racking fingers, wherein said diving board assembly is adapted to provide access from said fingerboard assembly to one or more pipes used during normal drilling operations; and a diving board clamping assembly that is adapted to maintain said pivotable diving board assembly in a first position under a first operating condition, to permit an angular rotation of said pivotable diving board assembly to a second position located at an angle relative to said plane of said fingerboard assembly under a second operating condition, to brake said angular rotation after the occurrence of said second operating condition, and to hold said diving board assembly fixed at said angle.

5. The diving board assembly of claim 4, wherein said angle is in the range of approximately ±90°.

6. The pipe racking system of claim 4, wherein an axis of rotation of said diving board assembly is located in a plane that is substantially parallel to said plane of said fingerboard assembly and substantially perpendicular to a longitudinal axis of said diving board assembly.

7. The pipe racking system of claim 4, wherein said first operating condition is a normal drilling load condition and said second operating condition is an impact drilling load condition, said impact drilling load condition occurring when an end of said diving board assembly proximate said drilling rig is subjected to an impact load during said normal drilling load operations.

8. The pipe racking system of claim 7, wherein said impact drilling load condition occurs when one of a moving travelling block assembly of said drilling rig, equipment supported by said moving travelling block assembly, or material supported by said moving travelling block assembly strikes said end of said diving board assembly during said normal drilling load condition.

9. The pipe racking system of claim 7, wherein said diving board clamping assembly comprises:

a cylindrically shaped structural member adapted to facilitate said angular rotation of said diving board assembly;

a clamp adapted to engage said cylindrically shaped structural member; and one or more shear pins adapted to facilitate the alignment of said diving board assembly in said first position and to hold said diving board assembly in said first position during said first operating condition.

10. The pipe racking system of claim 9, wherein said clamp comprises an upper clamp section, a lower clamp section, and a plurality of fasteners adapted to impart a clamping force between said upper and lower clamp sections and said cylindrically shaped structural member.

11. The pipe racking system of claim 4, further comprising a pipe handling system adapted for moving said one or more sections of pipe between an operating position of said one or more pipes during drilling operations and a preselected location between two of said racking fingers of said fingerboard assembly.

12. A diving board assembly adapted to provide access to a fingerboard assembly of a drilling rig pipe racking system, said diving board assembly comprising:

a first end proximate said drilling rig;

a second end positioned remote from said first end, wherein said first end is more proximal to said drilling rig than said second end, and wherein said first and second ends are positioned in a first plane;

at least one structural support member that is adapted to support a platform for accessing said fingerboard assembly, wherein said at least one structural support member is substantially parallel to said first plane; and a clamping assembly that is adapted to maintain said first plane of said diving board assembly substantially parallel to a plane defined by said fingerboard assembly during a normal operation of said drilling rig and to permit an angular rotation of said diving board assembly about an axis of rotation located in a plane that is substantially parallel to said plane of said fingerboard assembly when an impact load exceeding a predetermined level is imparted to said first end of said diving board assembly, wherein said plane of said fingerboard assembly is substantially horizontal.

13. The diving board assembly of claim 12, wherein said clamping assembly is adapted to permit said angular rotation when said impact load is imparted from below said first end of said diving board assembly.

14. The diving board assembly of claim 12, wherein said clamping assembly is adapted to permit said angular rotation when said impact load is imparted from above said first end of said diving board assembly.

15. The diving board assembly of claim 12, wherein said clamping assembly is further adapted to brake said angular rotation after said impact load and hold said diving board assembly at a fixed angle.

16. The diving board assembly of claim 15, wherein said fixed angle is in the range of approximately ±90° relative to said plane of said fingerboard assembly.

17. The diving board assembly of claim 12, further comprising a cylindrically shaped structural member, wherein a longitudinal axis of said cylindrically shaped structural member is coincident with said axis of rotation.

18. The diving board assembly of claim 17, wherein said cylindrically shaped structural member comprises a tubularly shaped member.

19. The diving board assembly of claim 17, wherein said cylindrically shaped structural member is fixedly attached to said fingerboard assembly.

20. The diving board assembly of claim 17, wherein said clamping assembly is adapted to clampingly engage and rotate about said cylindrically shaped structural member.

21. The diving board assembly of claim 20, wherein surfaces of said clamping assembly clampingly engaging said cylindrically shaped structural member are treated surfaces.

22. The diving board assembly of claim 21, wherein said treated surfaces are one of nitrided surfaces and carburized surfaces.

23. The diving board assembly of claim 20, wherein said clamping assembly comprises:

laterally opposing first and second sides straddling said axis of rotation, wherein said first and second sides are substantially aligned with said axis of rotation; and laterally opposing third and fourth sides running between said first and second sides.

24. The diving board assembly of claim 23, wherein said clamping assembly further comprises an upper clamp section and a lower clamp section disposed around an outside surface of said cylindrically shaped structural member.

25. The diving board assembly of claim 24, wherein said clamping assembly further comprises a plurality of first fasteners disposed along said first side and a plurality of second fasteners disposed along said second side, wherein said pluralities of first and second fasteners are adapted to impart a clamping force between said upper and lower clamp sections so as to clampingly engage said upper and lower clamp sections around said outside surface of said cylindrically shaped structural member.

26. The diving board assembly of claim 25, wherein each of said pluralities of first and second fasteners comprise a plurality of tension-indicating washers adapted to maintain said clamping force between said clamping assembly and said cylindrically shaped structural member.

27. The diving board assembly of claim 25, wherein each of said pluralities of first and second fasteners is adapted to maintain a gap between said upper clamp section and said lower claim section.

28. The diving board assembly of claim 27, wherein each of said pluralities of first and second fasteners comprise shoulder bolts.

29. The diving board assembly of claim 24, wherein said clamping assembly further comprises one or more shear pins, wherein each of said one or more shear pins is positioned so as to enable alignment of said diving board assembly in said plane that is substantially parallel to said plane of said fingerboard assembly.

30. The diving board assembly of claim 24, wherein each of said one or more shear pins comprises a threaded fastener.

31. The diving board assembly of claim 29, further comprising two end plates fixedly attached to said at least one structural support member, wherein each of said end plates is disposed outboard of, adjacent, and substantially parallel to one of each of said third and fourth sides of said clamping assembly.

32. The diving board assembly of claim 31, further comprising two shear plates fixedly attached to said cylindrically shaped structural member, wherein each of said shear plates is disposed outboard of, adjacent, and substantially parallel to one of each of said two end plates.

33. The diving board assembly of claim 32, wherein said lower clamp section, each of said two end plates, and each of said two shear plates comprise at least one shear pin hole, wherein each of said at least one shear pin holes is adapted to be concentrically aligned, and wherein said concentrically aligned shear pin holes are positioned so as to enable said alignment of said diving board assembly in said plane that is substantially parallel to said plane of said fingerboard assembly.

34. The diving board assembly of claim 33, wherein said lower clamp section is fixedly attached to said at least one structural support member.

35. The diving board assembly of claim 33, wherein said end plates and said shear plates are adapted to shear each of said one or more shear pins when said impact load imparted to said first end of said diving board assembly exceeds said predetermined level.

36. The diving board assembly of claim 12, wherein said at least one structural support member is further adapted to support components of a remotely operated pipe handling system.

37. The diving board assembly of claim 36, wherein said one or more structural support members are further adapted to support a control pod proximate said second end of said diving board assembly, said control pod comprising a control system for controlling said remotely operated pipe handling system.

38. A method of operating a rotatable impact-absorbing diving board assembly, said method comprising:

installing said rotatable impact-absorbing diving board assembly proximate a fingerboard assembly of a drilling rig, wherein a plane of at least a portion of said fingerboard assembly is substantially horizontal;

aligning said rotatable impact-absorbing diving board assembly with a plane that is substantially parallel to said plane of at least said portion of said fingerboard assembly;

after aligning said rotatable impact-absorbing diving board assembly, installing a plurality of shear pins through a clamping assembly of said impact-absorbing diving board assembly; and clamping said clamping assembly around a cylindrically shaped structural member, wherein said clamping assembly is adapted to permit an angular rotation of said rotatable impact-absorbing diving board assembly about a longitudinal axis of said cylindrically shaped structural member.

39. The method of claim 38, further comprising causing an angular rotation of said rotatable impact-absorbing diving board assembly about said cylindrically shaped structural member.

40. The method of claim 39, wherein causing said angular rotation comprises impacting an end of said rotatable impact-absorbing diving board assembly with an impact load during drilling rig operations.

41. The method of claim 40, wherein impacting said end of said rotatable impact-absorbing diving board assembly comprises striking said impact-absorbing diving board assembly with one of a moving travelling block assembly of said drilling rig, equipment supported by said moving travelling block assembly, or material supported by said moving travelling block assembly.

42. The method of claim 39, further comprising braking said angular rotation of said rotatable impact-absorbing diving board assembly and holding said rotatable impact-absorbing diving board assembly at a non-zero angle relative to said plane of at least said portion of said fingerboard assembly.

43. The method of claim 42, wherein clamping said clamping assembly around said cylindrically shaped structural member comprises tightening a plurality of fasteners to create a clamping force between said clamping assembly and said cylindrically shaped structural member.

44. The method of claim 43, wherein braking said angular rotation of said rotatable impact-absorbing diving board assembly comprises adjusting said clamping force between said clamping assembly and said cylindrically shaped structural member.

45. The method of claim 42, further comprising:

supporting a dead load of said rotatable impact-absorbing diving board assembly after braking said angular rotation;

loosening said clamping assembly by reducing a clamping force between said clamping assembly and said cylindrically shaped structural member after supporting said dead load;

re-aligning said rotatable impact-absorbing diving board assembly with said plane of at least said portion of said fingerboard assembly by rotating said rotatable impact-absorbing diving board assembly and said loosened clamping assembly about said cylindrically shaped structural member;

installing a plurality of shear pins through said clamping assembly after re-aligning said rotatable impact-absorbing diving board assembly; and re-clamping said clamping assembly around said cylindrically shaped structural member after installing said plurality of shear pins.

46. The method of claim 38, wherein said plurality of shear pins are installed through said clamping assembly before said clamping assembly is clamped around said cylindrically shaped structural member.

47. The method of claim 39, wherein causing said angular rotation of said rotatable impact-absorbing diving board assembly comprises shearing said plurality of shear pins.

48. A pipe racking system of a drilling rig, comprising:

a fingerboard assembly adapted for staging one or more sections of pipe in a substantially vertical orientation, wherein at least a portion of said fingerboard assembly is positioned in a substantially horizontal plane and comprises two laterally opposing rows of racking fingers;

a pivotable diving board assembly substantially disposed between said two laterally opposing rows of racking fingers, wherein said diving board assembly is adapted to provide access from said fingerboard assembly to one or more pipes used during normal drilling operations; and a diving board clamping assembly that is adapted to maintain said pivotable diving board assembly in a first position under a normal drilling load condition and to permit an angular rotation of said pivotable diving board assembly to a second position located at an angle relative to said plane of said fingerboard assembly under an impact drilling load condition, said impact drilling load condition occurring when an end of said diving board assembly proximate said drilling rig is subjected to an impact load during said normal drilling load condition.

49. The pipe racking system of claim 48, wherein said impact drilling load condition occurs when one of a moving travelling block assembly of said drilling rig, equipment supported by said moving travelling block assembly, or material supported by said moving travelling block assembly strikes said end of said diving board assembly during said normal drilling load condition.

50. The pipe racking system of claim 48, wherein said diving board clamping assembly comprises:

a cylindrically shaped structural member adapted to facilitate said angular rotation of said diving board assembly;

a clamp adapted to engage said cylindrically shaped structural member; and one or more shear pins adapted to facilitate the alignment of said diving board assembly in said first position and to hold said diving board assembly in said first position during said normal drilling load condition.

51. The pipe racking system of claim 50, wherein said clamp comprises an upper clamp section, a lower clamp section, and a plurality of fasteners adapted to impart a clamping force between said upper and lower clamp sections and said cylindrically shaped structural member.

52. A diving board assembly adapted to provide access to a fingerboard assembly of a drilling rig pipe racking system, said diving board assembly comprising:

a first end proximate said drilling rig;

a second end positioned remote from said first end, wherein said first end is more proximal to said drilling rig than said second end, and wherein said first and second ends are positioned in a first plane;

at least one structural support member that adapted to support a platform for accessing said fingerboard assembly, to support components of a remotely operated pipe handling system, and to support a control pod positioned proximate said second end, wherein said control pod comprises a control system for controlling said remotely operated pipe handling system and said at least one structural support member is substantially parallel to said first plane; and a clamping assembly adapted to maintain said first plane of said diving board assembly substantially parallel to a plane defined by said fingerboard assembly during a normal operation of said drilling rig, wherein said plane of said fingerboard assembly is substantially horizontal.

53. A method of operating a rotatable impact-absorbing diving board assembly, said method comprising:

installing said rotatable impact-absorbing diving board assembly proximate a fingerboard assembly of a drilling rig, wherein a plane of at least a portion of said fingerboard assembly is substantially horizontal;

aligning said rotatable impact-absorbing diving board assembly with a plane that is substantially parallel to said plane of at least said portion of said fingerboard assembly;

clamping a clamping assembly of said rotatable impact-absorbing diving board assembly around a cylindrically shaped structural member, wherein said clamping assembly is adapted to permit an angular rotation of said rotatable impact-absorbing diving board assembly about a longitudinal axis of said cylindrically shaped structural member;

causing an angular rotation of said rotatable impact-absorbing diving board assembly about said cylindrically shaped structural member;

braking said angular rotation of said rotatable impact-absorbing diving board assembly; and holding said rotatable impact-absorbing diving board assembly at a non-zero angle relative to said plane of at least said portion of said fingerboard assembly.

* * * * *